US006378858B1

(12) United States Patent
Suga

(10) Patent No.: US 6,378,858 B1
(45) Date of Patent: Apr. 30, 2002

(54) SHEET FEEDING APPARATUS, IMAGE FORMING APPARATUS HAVING THE SAME AND IMAGE READING APPARATUS HAVING THE SAME

(75) Inventor: Takeshi Suga, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/570,048

(22) Filed: May 12, 2000

(30) Foreign Application Priority Data

May 13, 1999 (JP) ..... 11-132396
Mar. 8, 2000 (JP) ..... 2000-063056

(51) Int. Cl.[7] ..... B65H 5/00

(52) U.S. Cl. ..... 271/10.01; 271/117; 271/121; 271/124

(58) Field of Search ..... 271/124, 125, 271/117, 118, 121, 122, 10.01, 10.09, 10.16

(56) References Cited

U.S. PATENT DOCUMENTS 4,288,068 A * 9/1981 Hashimoto et al. ..... 271/125
4,603,848 A * 8/1986 Markgraf et al. ..... 271/125
4,801,134 A * 1/1989 Yokoyama et al. ..... 271/122
5,016,866 A * 5/1991 Takahashi ..... 271/122
6,000,689 A * 12/1999 Furuki et al. ..... 271/10.11

FOREIGN PATENT DOCUMENTS

JP 3-18532 1/1991

* cited by examiner

*Primary Examiner*—David H. Bollinger
(74) *Attorney, Agent, or Firm*—Fitzpatrick, Cella, Harper & Scinto

(57) ABSTRACT

A sheet feeding apparatus has a sheet support for supporting sheets, a feed roller pressingly contacted with the sheets supported on the sheet support, the feed roller rotating in a sheet conveying direction for feeding the sheets, a separation rotator pressingly contacted with the feed roller and the separation rotator rotating in a direction of restoring the sheets so as to separate, sheet by sheet, the sheets fed out. The sheet feeding apparatus further has a pressure switch for switching pressure of the separation rotator with respect to the feed roller during rotating operation of the feed roller.

18 Claims, 27 Drawing Sheets

| | CONDITION | THE FIRST EARLIER TECHNOLOGY |
|---|---|---|
| EXPRESSION (1) | SHEET FEED CONDITION | Pb>0.633Ta-0.671Pa |
| EXPRESSION (2) | SEPARATION CONDITION | Pb<1.92Ta-2Pa |

| | CONDITION | THE FIRST EARLIER TECHNOLOGY |
|---|---|---|
| EXPRESSION (1) | SHEET FEED CONDITION | Pb>0.833Ta−0.167Pa |
| EXPRESSION (2) | SEPARATION CONDITION | Pb< Ta−2Pa |

SHEET FEEDING APPARATUS, IMAGE FORMING APPARATUS HAVING THE SAME AND IMAGE READING APPARATUS HAVING THE SAME

BACKGROUND OF THE INVENTION

1. Field of the Invention

The present invention relates to a sheet feeding apparatus for separating and feeding a sheet sheet by sheet and to an image forming apparatus such as a copying machine, a printer or the like or an image reading apparatus having the apparatus.

2. Related Background Art

Conventionally, for example, in a sheet feeding section of a copying machine or the like, a sheet separation using a retard roller rotating in a direction opposite to a sheet feeding direction has mainly used as a sheet feeding means for preventing a plurality of sheets from being fed (referred to as "double-feed" hereinafter).

A summary of a conventional sheet feeding apparatus utilizing a retard separation system will be described hereinafter.

FIG. 25 is a schematic side view of a sheet feeding apparatus utilizing a retard separation method constituted of a sheet feeding roller and a separation roller (see, Japanese Unexamined Patent Publication (KOKAI) Heisei No. 3-18532, U.S. Pat. No. 5,016,866). This is referred to as a first prior art hereinafter.

First, as shown in FIG. 25, sheets S stacked on a intermediate plate 206 in a cassette 207 are lifted together with the intermediate plate 206 by a pressing arm 208 and a sheet pressing spring 205 to be always pressingly contacted with the sheet feeding roller 201, thereby gaining sheet feeding pressure.

Also, the sheet feeding roller 201 receives retard pressure (separation roller pressure) from a separation roller 202. In this state, when the sheet feeding roller 201 rotates in a sheet feeding direction, the sheets S pressingly contacted with the sheet feeding roller 201 are fed out to reach a nip formed by the sheet feeding roller 201 and the separation roller 202. At this time, when a single sheet S is pinched by the nip, the separation roller 202 is also rotationally driven in the sheet feeding direction together with the sheet feeding roller 201 due to a torque limiter 203 formed integrally with a separation roller shaft, thereby feeding the sheet S.

When a plurality of the sheets are pinched in the nip, however, the separation roller 202 is rotated with predetermined torque in a direction to which the double-fed sheets are restored, with the operation of the torque limiter 203, thereby preventing the sheet double-feed.

In addition, FIG. 26 and FIG. 27 are schematic side views of a sheet feeding apparatus utilizing a retard separation system with a planetary gear mechanism (see, Japanese Patent Publication (KOKOKU) Heisei No. 1-32134). This is referred to as a second prior art hereinafter.

As shown in FIG. 26, this sheet feeding mechanism utilizes a planetary gear mechanism constituted of a sun gear 301, an intermediate gear 302, a planetary gear 303 and a connecting arm 304, and a sheet feeding roller 307 is connected to the planetary gear 303. Furthermore, a separation roller 309 is connected to a driving shaft 306 through a torque limiter, and a pair of draw rollers 310 for conveying a sheet S at a speed higher than a speed at which the sheet feeding roller 307 feeds the sheet S is disposed on a downstream of the sheet feeding roller 307 in a sheet feeding direction.

An operation of the sheet feeding mechanism will be briefly described hereinafter with reference to FIG. 27.

First, by rotation of the driving shaft 306, the planetary gear 303 and the sheet feeding roller 307 revolve in a direction indicated by an arrow A in FIG. 27, with the result that the sheet feeding roller 307 pressingly contacts with an uppermost sheet S of the sheets stacked within a sheet cassette. Also, in synchronous with the rotation, a lever 318 lifts an intermediate plate 323 stacking the sheets toward a direction of the sheet feeding roller (a direction indicated by an arrow G in FIG. 27).

By this operation, the sheet S pressingly contacted with the sheet feeding roller 307 is sent into a nip formed by the sheet feeding roller 307 and the separation roller 309, thereby feeding and separating the sheet S. Furthermore, the sheet S after passing through the nip enters into the pair of draw rollers 310, and the planetary gear mechanism and the sheet feeding roller 307 are returned to the initial positions by transmitting the driving force of the pair of draw rollers 310 through the sheet S to the planetary gear mechanism, and this operation is repeated.

Although the two prior arts in the sheet feeding mechanism are shown, it is considered that the respective prior arts can be improved in several points.

First, in the mechanism of the first prior art, the sheets S stacked on the intermediate plate 206 in the cassette 207 are lifted together with the intermediate plate 206 to be always pressed by the sheet pressing spring 205. Consequently, a sheet feed and separation condition greatly depends on the pressure of the intermediate plate, resulting in that an appropriate sheet feed area is limited in consideration of the pressure of the intermediate plate as a function.

In particular, because the pressures of the intermediate plate generated by the sheet pressing spring 205 vary with the number of sheets stacked in the cassette 207, the sheet feed and separation condition differs between a case where the sheets are fully loaded and a case where a several number of the sheets are loaded. Also, the pressure of the intermediate plate is always generated on the stacked sheets S since the sheets S are always pressingly contacted with the sheet feeding roller 201. Therefore, while the sheet S as the uppermost sheet is being fed, the sheet S' to be succeedingly fed is subjected to a conveying force by friction between the sheets, with the result that the double-feed of the sheet S' tends to easily occur.

In addition, even if the double-fed sheets are separated and tried to be returned to the former position, the sheet S is pinched by the sheet feeding roller 201 and the intermediate plate 206, and therefore the double-fed sheet may not be returned smoothly.

Furthermore, an allowable range of the appropriate sheet feed area is limited in dependence upon the kind of sheet (for example, sheet having great coefficient of the friction) or the reduction of frictional coefficients of the sheet feeding roller and the separation roller caused by wears, and as a result, the stability might be worsened. Therefore, it is hard to say that this mechanism is a sheet feeding mechanism having high stability and high reliability.

Incidentally, in this mechanism, when it is tried that the double-feed is hard to occur and the double-fed sheets can easily restored, the restoring force provided by the torque limiter 203 must be set to a greater value; the retard pressure of the retard spring must be considerably decreased; or the pressure of the intermediate plate provided by the sheet pressing spring 205 must be considerably decreased.

In any cases, however, slip between the sheet feeding roller 201 and the separation roller may be generated, with the result that the wear of the sheet feeding roller 201 and the separation roller 202 is accelerated, thereby considerably reducing enduring lifetime of the sheet feeding roller 201 and the separation roller 202. As a result, the number of periodical replacing operation for worn parts is increased to increase the maintenance cost of the sheet feeding apparatus. Furthermore, torque of the driving force applying means (motor) is required to increase, resulting that not only the cost of the apparatus but also power consumption must be increased.

In addition, when the restoring force of the torque limiter 203 is set to be a greater value, in a space Z formed between a nip portion X constituted of the sheet feeding roller 201 and the separation roller 202, and a pressingly contacting part Y between the sheet feeding roller 201 and the sheets on the intermediate plate 206, it is considered that the double-fed sheet (especially, thin sheet having poor elasticity) may be buckled, thereby causing sheet jam.

Also, when a pair of conveying rollers are provided on a downstream side of the sheet feeding roller 201 and the separation roller 202 in the conveying direction, it is considered that the pair of conveying rollers must draw the sheet, which is continuously under pressure, from the intermediate plate 206 as well as the nip between the sheet feeding roller 201 and the separation roller 202, with the result that greater load will act on the pair of conveying roller, thereby shortening the enduring lifetime of the conveying rollers.

Furthermore, since the intermediate plate 206 is always pressed by the sheet feeding roller 201 by means of the sheet pressing spring 205, if this prior art is applied to a multi-feeding section, a user, when setting sheets, must push the intermediate plate 206 down against the sheet pressing spring 205 to create a gap between the intermediate plate 206 and the sheet feeding roller 201, thus to insert the sheets into the gap.

Consequently, it is hard to say this apparatus has good operability, and as a result, the user easily fails in setting the sheets properly, which may, in turn, cause sheet jam or skew feed.

Next, in the mechanism of the second prior art, the sheet feeding roller 307 carries out pressing and estranging operations with respect to the stacked sheets S, and accompanying this operations, the intermediate plate 323 is also moved up and down by the lever 318, thereby effecting the pressing and the pressure releasing operations. In other words, when the sheets S stacked on the intermediate plate 323 are fed, the sheets S are in a state of being pinched by the sheet feeding roller 307 and the intermediate plate 323 from the upside and the downside.

Furthermore, the estranging operation of the sheet feeding roller 307 and the lowering operation of the lever 318 are effected by utilizing conveying force when the conveyed sheet S is pinched by the pair of draw rollers 310. Accordingly, the sheet feeding roller 307 and the intermediate plate 323 are in a state of pinching the stacked sheets S until a leading end of the conveyed sheet S reaches the nip between the pair of draw rollers 310.

Since the sheet feeding roller 307 pressingly contacts with the sheets S during the separating operation, the sheet are hard to be separated, and furthermore, since the leading end of the sheet S reaches the nip between the pair of draw rollers 310 while the sheet feeding roller 307 is under the pressingly contact operation, there is no timing for restoring the double-fed sheets.

In consideration of the sheet feeding and separation condition, the sheet feeding mechanism according to the second prior art is the same as the sheet feeding mechanism according to the first prior art. Thus, as is in the first prior art, in this mechanism, the appropriate sheet feed area is narrow, so it is hard to say that it has high stability and high reliability. In addition, the structure is very complicated and a large number of the parts are required.

Further, because the pressure releasing operation of the sheet feeding roller 307 with respect to the sheets S and the revolving operations of the planetary gear mechanism and the sheet feeding roller 307 are effected by the conveying force of the pair of draw rollers 310, great conveying load acts on the draw rollers 310, and it is, therefore, considered that the enduring lifetime of the draw rollers 310 becomes shortened.

As a problem common to the above two prior arts, there is raised a problem that stability and reliability of the sheet feeding and separation operations are not fully secured since the pressure of the intermediate plate affects the sheet feeding and separation condition. Further, there is raised as another problem that the double-feed easily occurs during the separating operation since the sheets stacked on the intermediate plate are pressingly contacted with the sheet feeding roller; there is no timing for restoring the double-fed sheets; and then, in dependence upon the kind of sheet, the sheet may be buckled to cause sheet jam.

SUMMARY OF THE INVENTION

In consideration of the above-mentioned problems, it is an object of the present invention to provide a sheet feeding apparatus which accomplishes both high enduring property and high separating property with a simple structure to achieve improving stability and reliability as a sheet feeding apparatus, reduces maintenance cost of the apparatus, and accomplishes both the cost reduction and the apparatus miniaturization due to simplification of the structure.

In order to accomplish the above objects, it is a representative structure according to the present invention to include sheet supporting means for supporting sheets, feeding means pressingly contacting with the sheet supported by the sheet supporting means to rotate in a direction of conveying the sheets for feeding the sheet, a separation rotator pressingly contacting with the feeding means to rotate in a direction to which the sheet is restored for separating the sheets fed from the feeding means to be a piece, drive transmitting means for driving the feeding means, and pressure switching means for switching pressure of the separation roller with respect to the feed means.

BRIEF DESCRIPTION OF THE DRAWINGS

The above and other objects and features of the invention are apparent to those skilled in the art from the following referred embodiments thereof when considered in conjunction with the accompanied drawings, in which.

DESCRIPTION OF THE PREFERRED EMBODIMENTS

Figure 1:
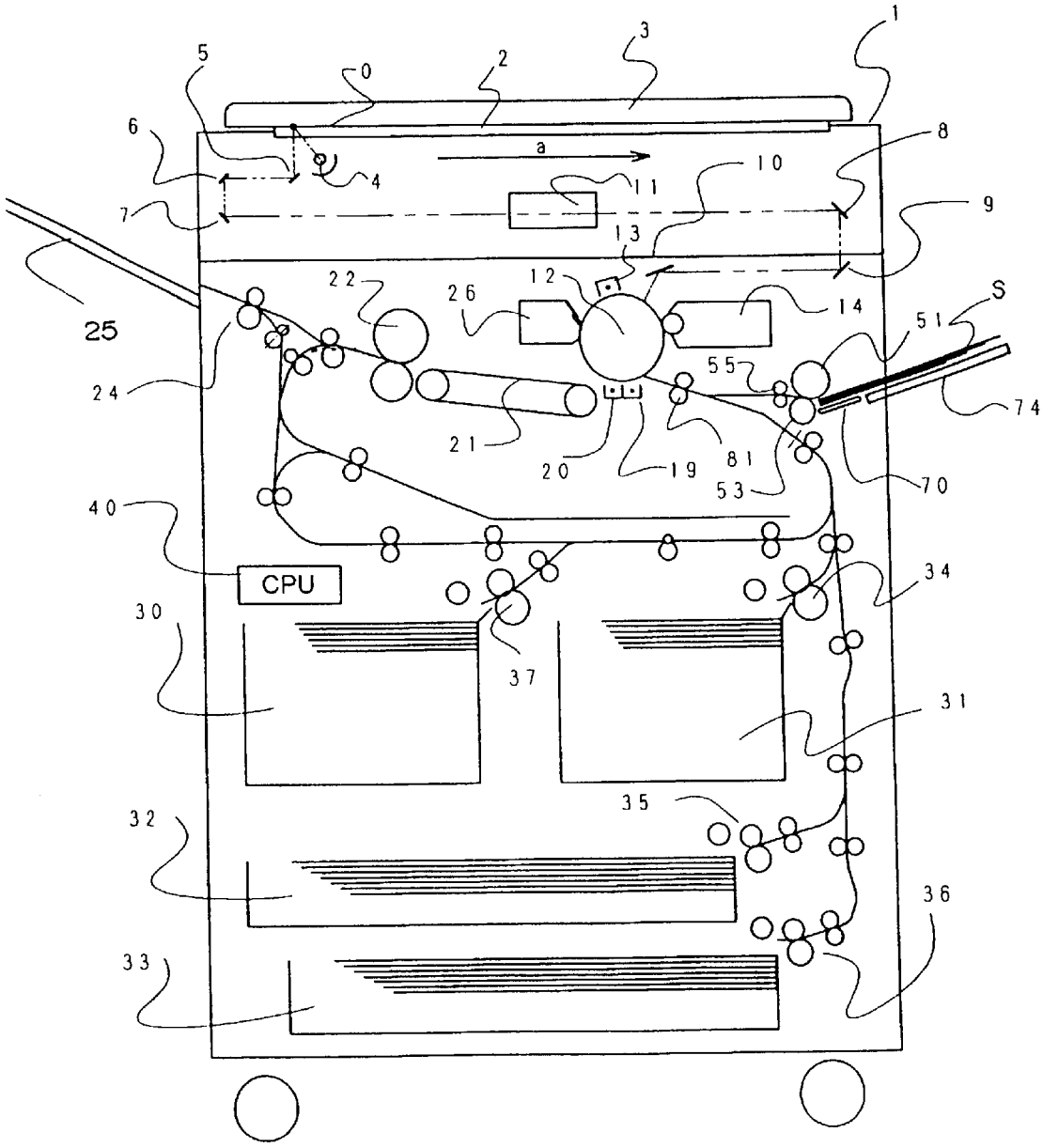
FIG. 1 is a schematic sectional view showing an image forming apparatus having a sheet feeding apparatus according to the present invention.

An image forming apparatus having a sheet feeding apparatus according to the present invention will be hereinafter described in detail. FIG. 1 is a sectional view showing an image forming apparatus having a sheet feeding apparatus according to the present invention. It is noted that copying machines are exemplified as the image forming machines in the embodiments according to the present invention.

In FIG. 1, numeral 1 refers to a main body of a copying machine, and in an upper portion of the main body 1 of the copying machine, an original document board 2 constituted of a secured transparent glass plate is provided. Numeral 3 refers to an original document pressing and fixing plate for pressing and fixing an original document O rested on the original document board 2 at a predetermined position with an image surface of the original document O facing down. Below the original document board 2, provided is an optical system including a lamp 4 for illuminating the original document O, reflecting mirrors 5, 6, 7, 8, 9, 10 for directing a light image of the illuminated original document O to a photosensitive drum 12, and an imaging lens 11 for imaging the light image. Incidentally, the lamp 4 and the reflecting mirrors 5, 6, 7 are moved at a predetermined speed in a direction indicated by the arrow A to scan the original document O.

An image forming section as an image forming means includes the photosensitive drum 12, a charger 13 for uniformly charging the surface of the photosensitive drum 12, a developing unit 14 for forming toner images to be transferred to a sheet S, by developing an electrostatic latent image formed, by the light image radiated from the optical system, on the surface of the photosensitive drum 12 charged by the charger 13, a transfer charger 19 for transferring the toner image developed on the surface of the photosensitive drum 12 onto the sheet S, a separation charger for separating the sheet S to which the toner image is transferred from the photosensitive drum 12, and a cleaner 26 for removing residual toner from the sensitive drum 12 after the transferring of the toner image.

On a downstream side of the image forming section, there are provided a transporting section 21 for transporting the sheet S to which the toner image is transferred, and a fixing unit 22 for fixing, as a permanent image, the image onto the sheet S transported by transporting section 21. Also, there are provided delivering rollers 24 for delivering the sheet S to which the image is fixed by the fixing unit 22 out of the main body 1 of the copying machine, and a delivering tray 25 for receiving the sheet S delivered by the delivering roller 24 is provided outside the main body 1 of the copying machine.

As feeding sections, there are provided cassette feeding sections 34, 35, 36, and 37 for feeding sheets stacked in sheet cassettes 30, 31, 32, and 33 contained within the main body 1 of the copying machine to an image forming section, and a feeding section 51, 53, 55, 70 (referred to as "multi-feeding section" hereinafter) for successively feeding sheets with various types of materials or various sizes from a sheet feeding tray 74 to the image forming section. In addition, it is possible to conduct a double-sided copying operation where a sheet finishing image forming on one side of its surfaces is reversed, through a re-feeding path 38, to make the front and back sides of the sheet face opposite directions respectively, and then the sheet is conveyed again to the image forming section to conduct image forming on the other side of the surfaces, and thereafter delivered to the delivery tray 25.

(First Embodiment)

Next, the multi-sheet feeding section of the above-mentioned image forming apparatus as a first embodiment according to the present invention will be explained in detail.

Figure 2:
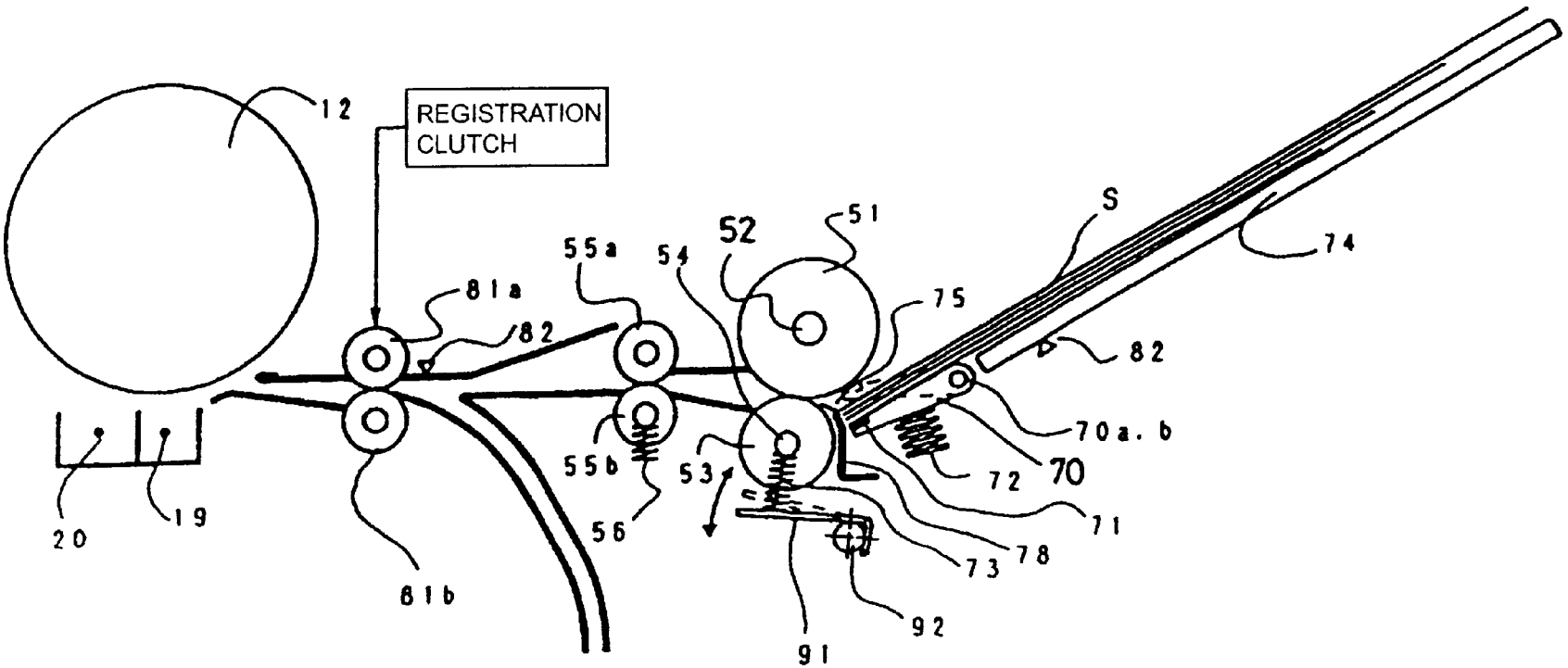
FIG. 2 is a sectional view of an essential portion showing a sheet feeding apparatus of a multi-feeding section.
Figure 3:
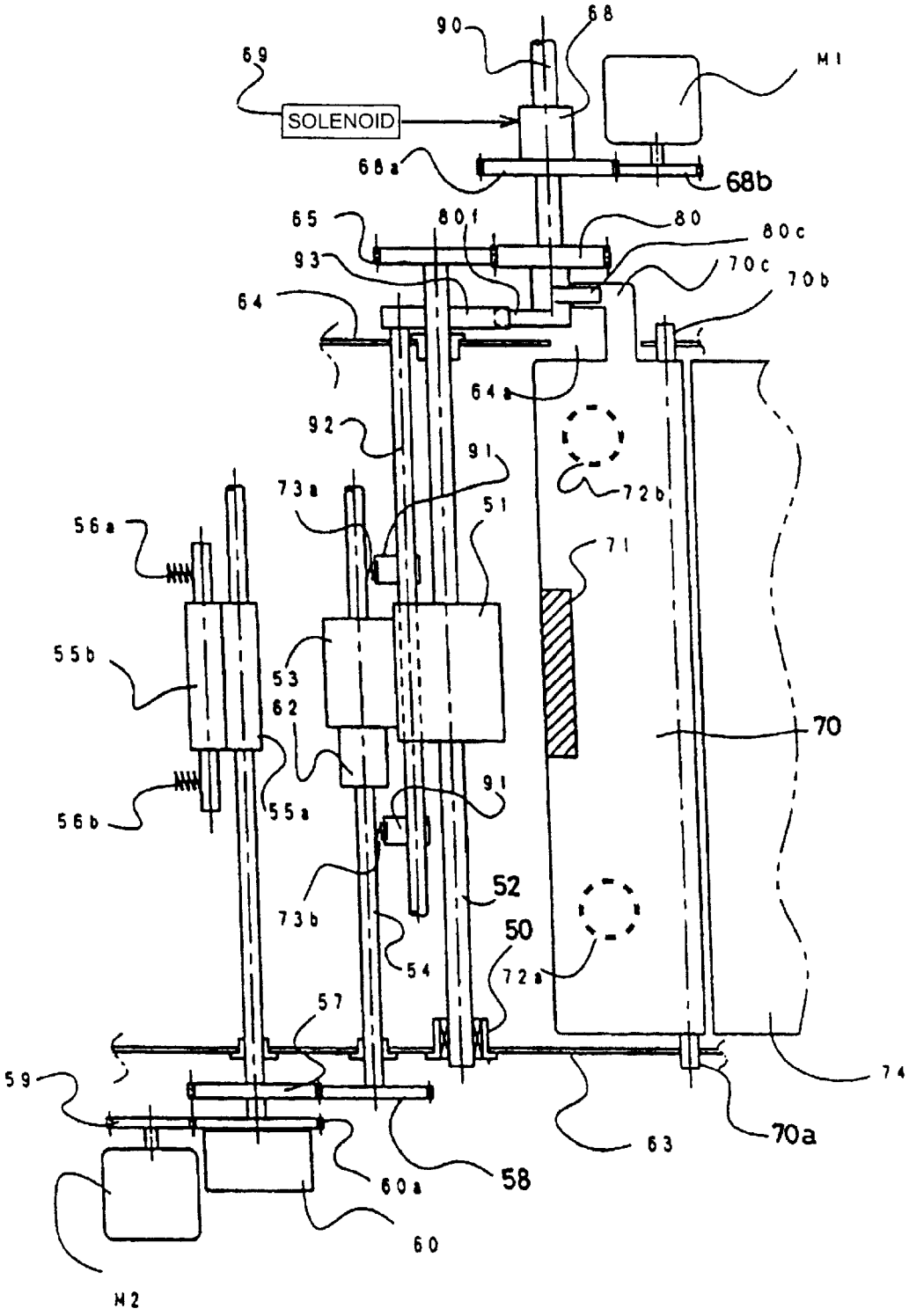
FIG. 3 is a drive development view of the multi-feeding section of a first embodiment according to the present invention.

FIG. 2 is a sectional view of the multi-feeding section and the image forming apparatus, and FIG. 3 is a drive development view (plan view) of the multi-feeding section.

In the main body 1 of the copying machine, a multi-sheet feeding tray 74 serving as a sheet supporting means for stacking and supporting a sheet bundle S is provided. The multi-sheet feeding tray 74 is provided with a sheet detecting sensor 82 comprising a photo-interrupter or the like for detecting presence or absence of the sheets S on the tray 74.

Also, it is so structured that an intermediate plate 70 as a supporting member for supporting sheets is provided so as to swingably move around fulcrums 70*a*, 70*b* with respect to front and rear side plates 63, 64 and is urged with moment toward a clockwise direction in FIG. 2 (a direction of pressing a sheet feeding roller 51) by pressing springs 72*a*, 72*b* (72) as pressing and estranging means, but also that the intermediate plate suitably can be pressingly contacted with respect to the sheet feeding roller 51 as a feeding means (a situation as shown by the broken line in FIG. 2) or released from the pressingly contacting operation (a situation as shown by the solid line in FIG. 2).

Further, a felt 71 for relieving shock on the intermediate plate 70 against the sheet feeding roller 51 during the pushing operation is provided at a directly contacting portion of the intermediate plate 70 with the sheet feeding roller 51. A separation roller 53 as a separation rotator to be rotationally driven by a predetermined restoring force in a direction opposite to the sheet feeding-conveying direction is directly and pressingly contacted with the sheet feeding roller 51.

In addition, a hitting plate 78 serving as a hitting portion when a user sets the sheets S on the multi-sheet feeding tray 74 is secured between the separation roller 53 and the intermediate plate 70. At a tip of the hitting plate 78, there is provided a leading guide 75 formed of a thin plate such as polyethylene sheet, SUS material or the like for guiding a leading end of the sheet to a nip formed by the sheet feeding roller 51 and the separating roller 53, with the result that this prevents the leading end of the sheet from curling or bending caused when the leading end of the sheet hits the separation roller 53.

Next, a control section for pressing force Pr of the sheet feeding roller 51, the intermediate plate 70 and the separation roller 53 as mentioned above will be explained.

The sheet feeding roller 51 as a feeding rotator is secured to a sheet feeding roller shaft 52, and the sheet feeding roller shaft 52 is rotatably and pivotally supported by the front side plate 63 and the rear side plate 64, but the sheet feeding roller 51 is not rotated reversely (in a counterclockwise direction in FIG. 2) by the action of a one-way clutch 50 disposed between the front side plate 63 and the sheet feeding roller shaft 52. Further, a sheet feeding gear 65 is secured to a rear end of the sheet feeding roller shaft 52.

In addition, there is provided, at a position to which the sheet feeding gear 65 opposes for engagement, a driving gear 80 as a drive transmitting means engageable with the sheet feeding gear 65 and having two toothless portions 80*a*, 80*b* as non-engagement portions.

A pressing and estranging cam portion 80*c* as a pressing and estranging means for making the sheets supported on the intermediate plate 70 pressingly contacted or released from the pressingly contacting operation with respect to the sheet feeding roller 51 is integrally formed with the driving gear 80, and a pressing and estranging cam follower 70*c* is to be directly contacted with the pressing and estranging cam portion 80*c*, the pressing and estranging cam follower 70*c* being integrally formed at the rear side of the intermediate plate 70 and penetrating a hole 64*a* provided on the rear side plate 64 so as to extend to a position opposed and directly contacted with the pressing and estranging cam portion 80*c*. Because of this, the rotation of the intermediate plate 70 in a clockwise direction in FIG. 2 is regulated.

Further, a pressure switching cam portion 80*f* as a pressing force switching means for switching pressure of the separation roller 53 against the sheet feeding roller 51, described later, is integrally formed with the driving gear 80. A pressure switching cam follower 93 is directly contacted to a position opposed and directly contacted with the pressure switching cam portion 80*f*. The pressure switching cam follower 93 is secured to a rotating shaft 92 pivotally supported rotatably on the front and rear side plates 63, 64 so as to be rotatable, and provided with rotation moment toward a clockwise direction in FIG. 4 by a spring (not shown), but this rotation is regulated by the direct contact of the pressure switching cam follower 93 with the pressure switching cam portion 80*f*. Then, along the rotation of the pressure switching cam portion 80*f*, the pressure switching cam follower 93 follows an outer circumference of the pressure switching cam portion 80*f* so that the pressure switching cam follower 93 and the rotating shaft 92 are integrally rotated.

The driving gear 80 is secured to a driving shaft 90 having a spring clutch 68 so as to control the driving of one revolution. One revolution of the spring clutch 68 is controlled by turning ON a solenoid 69 for controlling the spring clutch 68 by a time of T1 (sec), and the phase angles of the spring clutch 68 and the toothless portion 80*a* are selected so that the toothless portion 80*a* of the driving gear 80 is normally positioned opposite to the sheet feeding gear 65. With this arrangement, in an initial state, the sheet feeding gear 65, the sheet feeding roller shaft 52, and the sheet feeding roller 51 can be rotated in a sheet conveying direction with no load.

A pair of draw rollers 55 as a conveying means are disposed on a downstream side of the sheet feeding roller 51 in the sheet conveying direction. A draw driving roller 55*a* is pivotally supported to be rotatable by respective front and rear side plates 63 and 64 via bearings (not shown), and a draw clutch 60 constituted of an electromagnetic clutch is provided on an end of a shaft to which the draw driving roller 55*a* is connected so that driving force from a draw motor M2 can be disconnected via gears 59 and 60*a*.

In addition, a draw driven roller 55*b* is pressed in a direction of the draw driving roller 55*a* by springs 56*a*, 56*b* via a bearing member (not shown) so as to oppose to the draw driving roller 55*a*.

A gear 57 is secured to the driving shaft of the draw driving roller 55*a* so that driving force can be transmitted to a separation roller driving shaft 54 via a gear 58. Incidentally, since the gears 57, 58 are secured to the driving shaft of the draw driving roller 55 and the separation roller driving shaft 54 respectively, so that the pair of draw rollers 55 and the separation roller driving shaft 54 are synchronously rotated. Further, the gear columns 57, 58 are respectively selected so that the pair of draw rollers 55 are rotated in the sheet conveying direction (clockwise direction in FIG. 2) and the separation roller driving shaft 54 is rotated in a direction opposite to the sheet feeding direction (clockwise direction in FIG. 2). In other words, when the electromagnetic clutch 60 is turned ON, a driving force of the draw motor M2 is transmitted, with the result that the pair of draw rollers 55 are rotated in the sheet conveying direction and at the same time the separation roller driving shaft 54 is rotated in the direction opposite to the sheet conveying direction.

Further, the separation roller 53 as a separation rotator is rotatably provided on the separation roller driving shaft 54 via a torque limiter 62 for generating predetermined torque. The separation roller 53 is disposed opposite to the sheet feeding roller 51 so as to pressingly contact with the sheet feeding roller 51 by separation roller pressing springs 73*a*, 73*b* via bearings (not shown) at their one end. Incidentally, at the other end of the springs, there is provided a spring receiver 91. This spring receiver 91 is secured to the rotating shaft 92 so as to be displaced along the rotation of the rotating shaft 92 by the operation of the pressure switching cam portion 80*f* explained before, but normally is kept in a state shown as the solid line in FIG. 2 by the operation of the pressure switching cam portion 80*f* and the pressure switching cam follower 93 (referred to as "separation position" hereinafter, in which the pressure Pr at this time is P1). Then, the spring receiver 91 is so structured as to be displaced to the broken line in FIG. 2 (referred to as "sheet feeding position" hereinafter, in which the pressure Pr at this time is P2) by the rotation of the pressure switching cam portion 80*f*. As mentioned above, the pressure Pr of the separation roller 53 against the sheet feeding roller 53 is switchable by displacing the spring receiver 91 of the separation roller pressing spring 73 from the separation position to the sheet feeding position.

As mentioned above, at a position to which the sheet feeding gear 65 opposes for engagement, there is provided the driving gear 80 formed integrally with a first gear portion 80*d* and a second gear portion 80*e* engageable with the sheet feeding gear 65, two toothless portions 80*a*, 80*b*, the pressing and estranging cam portion 80*c* through which the intermediate plate 70 is pressed against, or released from the pressing operation against the sheet feeding roller 51, and the pressure switching cam portion 80*f* for switching the pressure Pr of the separation roller 53, and it is so structured, as mentioned above, that one revolution of the driving gear 80 can be controlled by the spring clutch 68 and the solenoid 69. Incidentally, the structure of the spring clutch 68 does not relate to essence of the present invention, so the detailed explanation thereof will be omitted.

Then, it is structured so that the driving control of the sheet feeding roller 51 and the switching pressure of the separation roller 53 against the sheet feeding roller 51 are carried out by controlling one revolution of the driving gear 80 having the gear portions and the toothless portions.

In addition, swinging the intermediate plate 70 by the revolution of the driving gear 80 as mentioned above allows the sheets stacked on the intermediate plate 70 to be pressingly contacted and released from the pressingly contacting operation with respect to the sheet feeding roller 51.

Next, controlling operations of the sheet feeding roller 51, the intermediate plate 70 and the pressure Pr of the separation roller 53 will be explained with reference to FIGS from FIG. 4 to FIG. 7.

Figure 4:
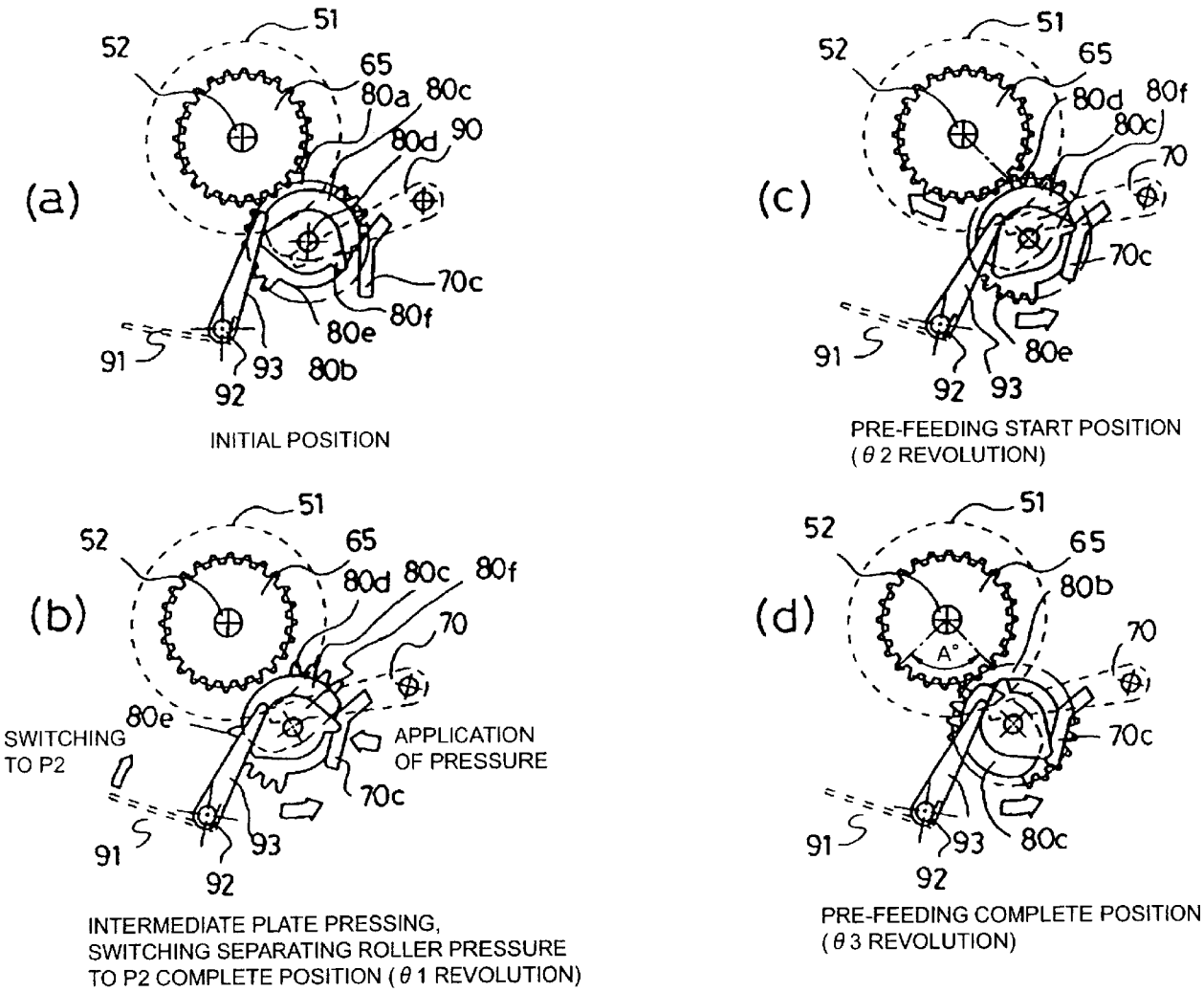
FIG. 4 is a view showing a state of operation of a driving gear of the first embodiment.
Figure 6:
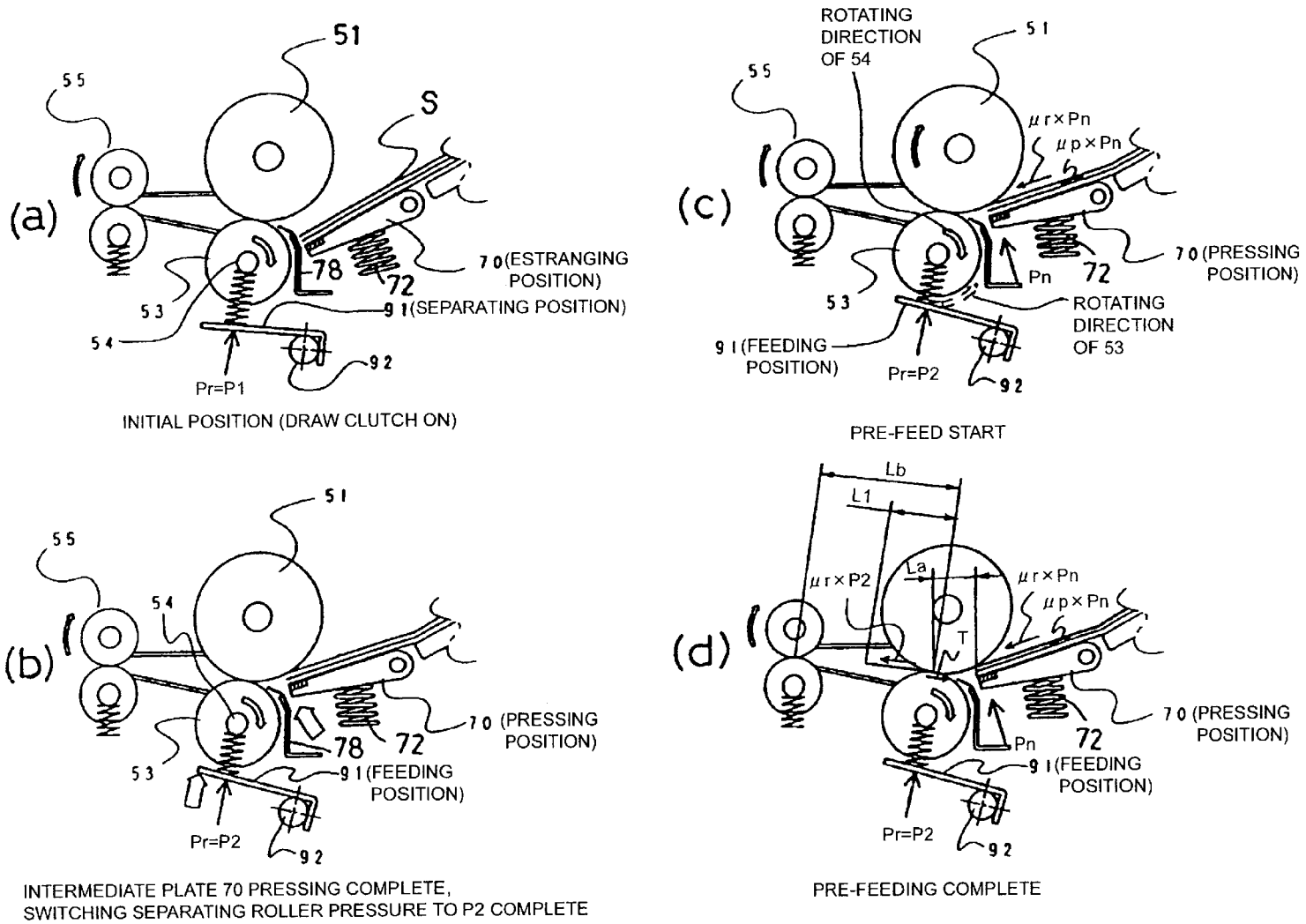
FIG. 6 is a view showing a state of operation of a multi-feeding section of the first embodiment.

Since, in the initial status (status shown in FIG. 4(*a*), FIG. 6(*a*)), the phase angle of the spring clutch 68 and the configuration of the first toothless portion 80*a* are selected so that the first toothless portion 80*a* of the driving gear 80 is opposed to the sheet feeding gear 65, the sheet feeding roller shaft 52 is rotatable, but the rotation of the sheet feeding roller shaft 52 in the direction opposite to the sheet feeding direction is regulated by the action of the one-way clutch 50. In addition, the cam configuration and the phase angle to the toothless portion 80*a* of the pressing estranging cam portion 80*c* and the pressure switching cam portion 80*f* are respectively selected so that the pressing estranging cam portion 80*c* is directly contacted with the pressure estranging cam follower 70*c* provided at the end of the intermediate plate in order that the intermediate plate 70 is normally urged by the pressing spring 72 to be estranged and also that, through the pressure switching cam portion 80*f*, the spring receiver 91 of the separation roller pressing spring 73 is in a position indicated by the solid line (separation position) in order that the pressure Pr of the separation roller 53 takes lower value P1.

As mentioned above, since the intermediate plate 70 is estranged from the sheet feeding roller 51 in the initial status, the user, when setting a sheet bundle, can set easily the sheet bundle until the sheet bundle directly contacts with the hitting plate 78.

Next, turning ON the solenoid 69 only by T1 (sec) starts rotation of the driving gear 80 due to the action of the spring clutch 68. The driving gear 80 starts rotating in a counterclockwise direction in FIG. 4 to rotate to a position θ1, with the result that the pressing estranging cam portion 80*c* is switched from the intermediate plate estranging position to the intermediate plate pressing position and also that the pressure switching cam portion 80*f* for switching the separation roller pressure Pr is switched from the separation position to the sheet feeding position.

Accordingly, the pressing and estranging cam follower 70*c* and the pressure switching cam follower 93 follow the respective cam outer circumferences, and as a result, the intermediate plate 70 is displaced to be pressed with the sheet feeding roller 51, and the pressure Pr of the separation roller is switched to a higher value P2. Then, by the action of the pressing and estranging cam portion 80*c*, an uppermost sheet S in the sheet bundle stacked on the sheet feeding tray 74 and the intermediate plate 70 is pressingly contacted with the sheet feeding roller 51. Incidentally, during this time, the sheet feeding gear 65 and the driving gear 80 are not engaged each other, so the sheet feeding roller 51 is stopped (status shown in FIG. 4(*b*) and FIG. 6(*b*).

When the driving gear 80 is further rotated up to a position θ2, the first gear portion 80*d* provided in the driving gear 80 is engaged with the sheet feeding gear 65 to rotate the sheet feeding gear 65 to a predetermined angle. According to this rotation, the sheet feeding roller 51 is rotated through an angle A° to feed out the uppermost sheet S in the sheet bundle by a predetermined amount L1 (the sheet feeding operation till now is referred to as "pre-feeding operation" hereinafter) (status in FIGS. 4(*c*), (*d*) and FIGS. 6(*c*), (*d*)).

Incidentally, provided that an outer diameter of the sheet feeding roller 51 is D, a feeding amount L1 in the pre-feeding operation is represented by the following formula:

$$L1 = A^\circ \times \pi \times D/360^\circ \qquad \text{(Formula 1)}$$

The number of teeth of the first gear portion 80*d* is selected so that the sheet feeding amount L1 during the pre-feeding becomes greater than a distance La from the sheet hitting plate 78 to the nip formed by the sheet feeding roller 51 and the separation roller 53 and smaller than a distance Lb from the nip position to the pair of draw rollers 55. Because of this, the leading end of the sheet S thus pre-fed can be stopped surely at a portion between the position of the nip formed by the sheet feeding roller 51 and the separation roller 53 and the position of the nip of the pair of the draw rollers 55.

Incidentally, the rotating speed of the sheet feeding motor M1, and the number of the teeth, the roller diameter or the like of the drive transmitting gear 68*a*, 68*b* (see, FIG. 3) or the like are selected so that the rotating speed of the sheet feeding roller driving gear 65 is determined to make the sheet feeding speed of the sheet feeding roller 51 substantially equal to or a little slower than the pair of draw rollers 55 or a pair of register rollers 82.

Then, when the driving gear 80 is further rotated up to a position 03 until the second toothless portion 80*d* reaches at the position to which the sheet feeding gear 65 is opposed for engagement (status in FIG. 4(*d*), FIG. 6(*d*)), the driving force is not transmitted to the sheet feeding gear 65, thereby stopping the sheet feeding roller 51 temporarily. Incidentally, since the number of teeth of the first gear portion 80*d* is selected as mentioned above, regardless of the sheet feeding starting position of the sheet S, the leading end of the sheet fed by the amount L1 in the pre-feeding operation can surely be stopped temporarily between the nip and the pair of draw rollers 55.

Thereafter, when the driving gear 80 is further rotated up to a position θ4 to return the pressing and estranging cam portion 80*c* to the intermediate plate estranging position, the pressing and estranging cam portion 80*c* is directly contacted with the pressing and estranging cam follower 80*c*, thus to estrange the intermediate plate 70 from the sheet feeding roller 51. At the same time, the pressure switching cam portion 80*f* is switched to the separation position and the pressure Pr of the separation roller 53 is switched to the lower value P1 (status in FIG. 5(*e*) and FIG. 7(*e*)).

The driving gear 80 is further rotated up to a position θ5 to return the pressure switching cam portion 80*f* again to the sheet feeding position, and the pressure Pr of the separation roller 53 is returned to the higher value P2. Therefore, the pressure Pr of the separation roller 53 can be kept in the lower value P1 while the driving gear 80 is rotated from θ4 to θ5. At the same time, engagement of the second gear portion 80*e* of the driving gear 80 with the sheet feeding gear 65 (status in FIG. 5(*f*) and FIG. 7(*f*)) allows the sheet feeding gear 65 to resume the rotation to rotate at a predetermined angle, and along this rotation, the sheet feeding roller 51 is rotated through angle B° to resume the sheet conveyance (the sheet feeding operation after pre-sheet feeding operation is referred to as "re-feeding" hereinafter).

The feeding amount L2 by the sheet feeding roller 51 at this time becomes:

$$L2=B^\circ\times\pi\times D/360^\circ \quad \text{(Formula 2)}$$

Incidentally, the number of teeth of the second gear portion 80*e* is selected so that a feeding amount L2 in the re-feeding operation becomes an amount which can surely bring the leading end of the sheet fed in front of the pair of draw rollers 55 in the pre-feeding operation at least to the pair of draw rollers 55 as well as an amount which does not reach the pair of register rollers 81. Then, the rotation of the driving gear 80 is further advanced, and when the first toothless portion 80*a* reaches at the position to which the sheet feeding gear 65 is opposed, the driving gear 65 does not receive the driving force, thereby stopping the rotation of the sheet feeding roller 51.

Also, the pressure switching cam portion 80*f* is again switched to the separation position, with the result that the pressure Pr of the separation roller 53 becomes a lower value P1. Then, the driving gear 80, after completing one revolution, is stopped at the initial position (status in FIG. 5(*g*) and FIG. 7(*g*)).

Figure 8:
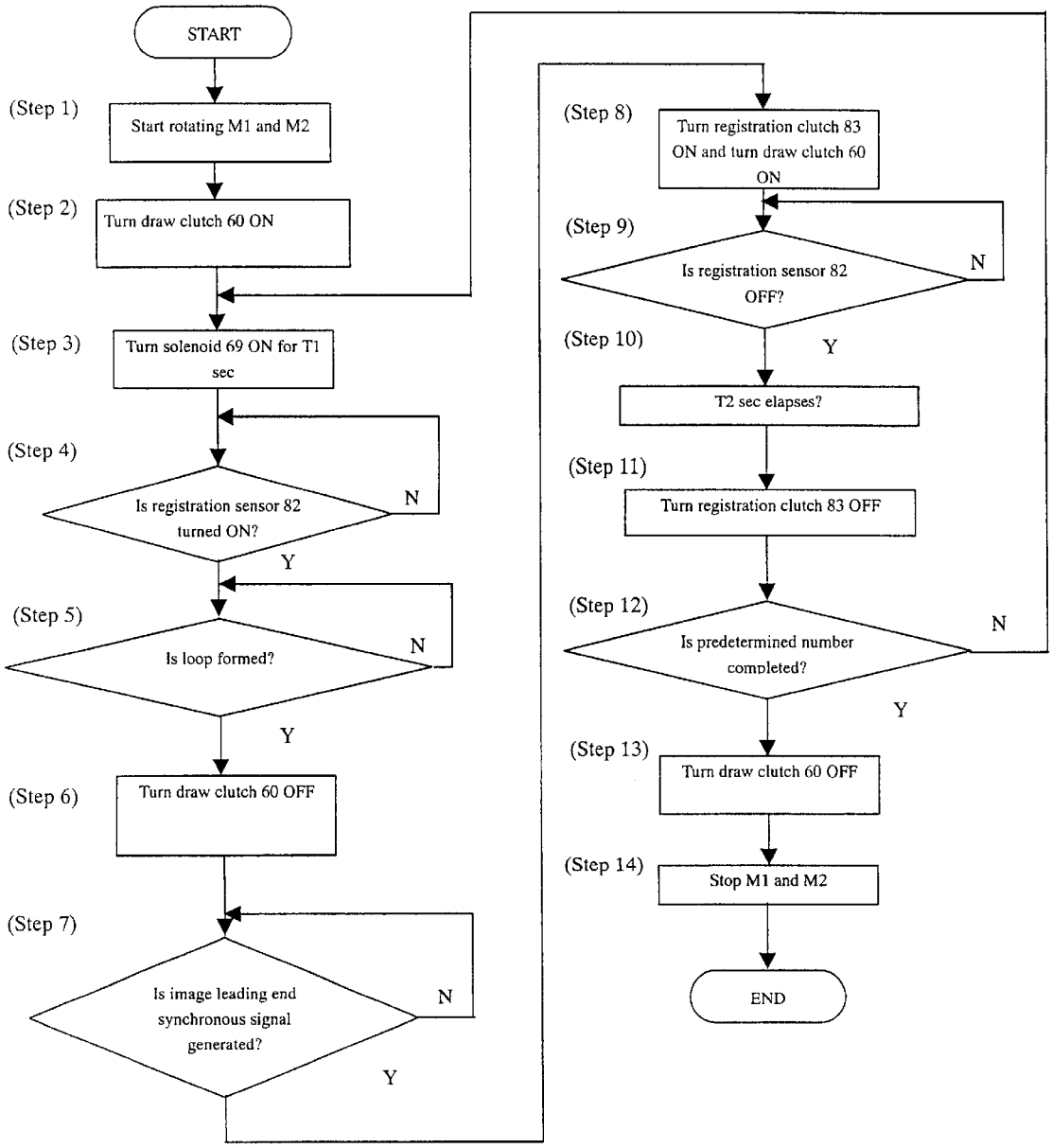
FIG. 8 is an operation flowchart during the sheet feeding of the first embodiment.
Figure 9:
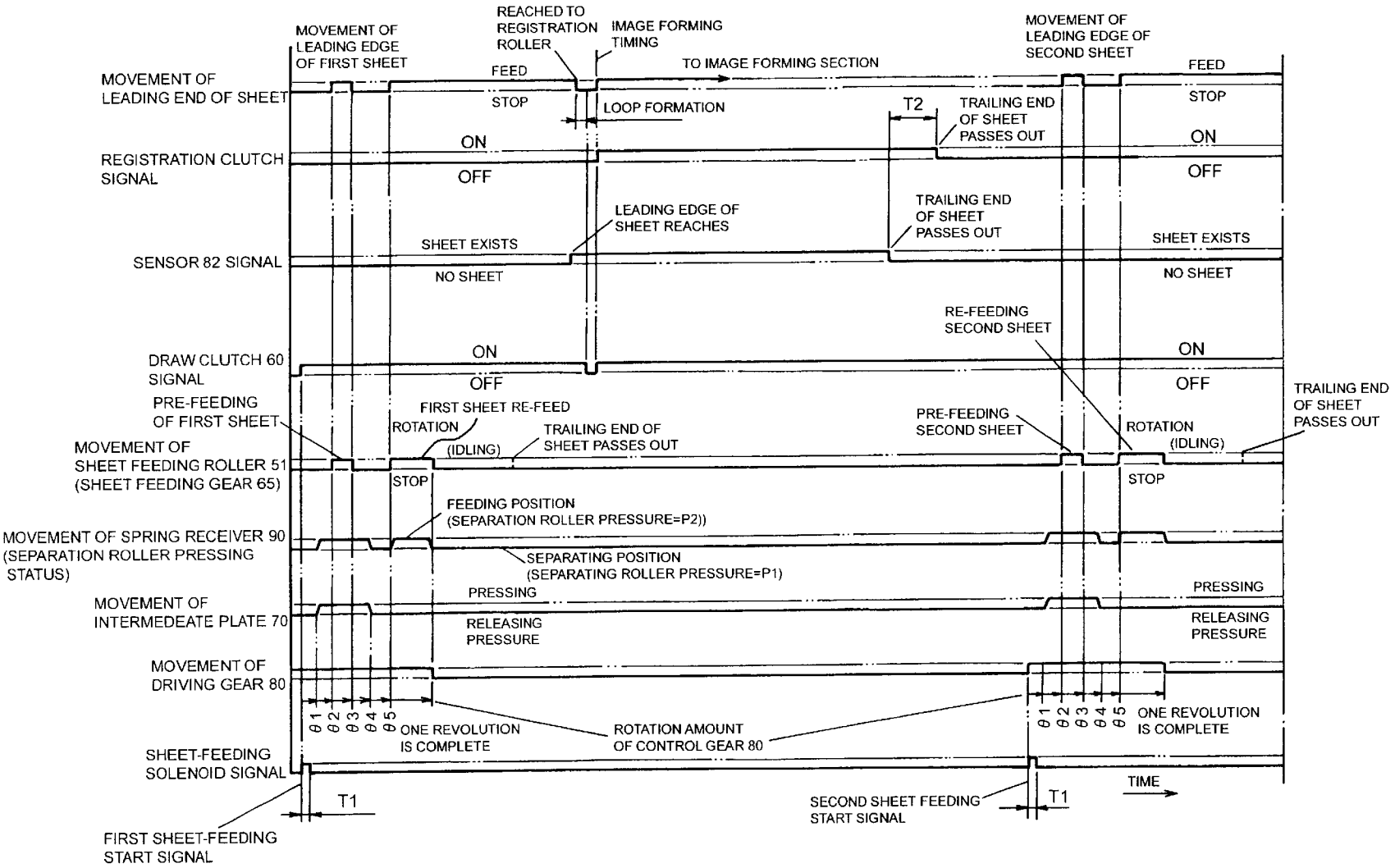
FIG. 9 is an operation timing chart during the sheet feeding of the first embodiment.

Next, the operation of feeding sheets from the multi-feeding section will be explained with reference to a flowchart shown in FIG. 8 and a timing chart shown in FIG. 9.

In a state that the sheet bundle is stored on the sheet feeding tray 74, when a start button (not shown) is pressed, the draw motor M2 and the sheet feeding motor M1 start to rotate respectively (step 1), and an ON signal of the draw clutch 60 is issued from a CPU 40 (step 2). As a result, as mentioned above, the pair of draw rollers 55 start to rotate in the sheet conveying direction and the separation roller driving shaft 54 is rotated in a direction opposite to the sheet conveying direction. Although a predetermined restoring force is generated in the separation roller 53 by torque generated by the torque limiter 62, the separation roller 53 stays still due to friction force with the sheet feeding roller 51 where the one-way clutch 50 regulates the rotation in the reverse direction.

Next, after a predetermined time period is elapsed, a signal from the CPU 40 turns ON the solenoid 69 (Step 3) to start the control of one revolution of the driving gear 80. By this operation, as mentioned above, the sheets supported on the intermediate plate 70 are first pressingly contacted with the sheet feeding roller 51 and the pressure Pr of the separation roller becomes a high value P2.

Then, the sheet feeding roller 51 is rotated only through a predetermined angle A°, and the uppermost sheet S stacked on the tray 74 is conveyed by a predetermined amount L1 by the pressure of the intermediate plate 70 and the friction force of the surface of the sheet feeding roller 51 (pre-feeding operation). Incidentally, the separation roller 51 is driven to rotate in the sheet feeding direction by the rotation of the sheet feeding roller 51. By the way, in the above-mentioned pre-feeding operation, if two or more sheets are fed together in an overlapped state (what is called double-feed), the separation roller 53 tries to operate so as to restore the double-fed sheets S1, but at this time, since the intermediate plate 70 is pressed with the sheet feeding roller 51 by the intermediate plate spring 72, the separating operation by the separation roller 53 may be obstructed and, furthermore, the double-fed sheets S1 may not be restored since the pressure Pr of the separation roller is higher value P2.

However, when the driving gear 80 is further rotated, the sheet feeding roller 51 is stopped temporarily, and thereafter, the intermediate plate 70 is released from the pressingly contacting operation with the sheet feeding roller 51 to be estranged thereof by the action of the pressing and estranging cam portion 80*c* and the pressing and estranging cam follower 70*c*, and also the pressure Pr of the separation roller 53 is switched to the lower value P1 by the action of the pressure switching cam portion 80*f* and the pressure switching cam follower 93.

At this time, since the tuned-ON state of the draw clutch 60 is maintained, the separation roller driving shaft 54 continues to rotate in the direction opposite to the sheet conveying direction, and also estranging the intermediate plate 70 allows the double-fed sheets to be released from the binding force and the pressure Pr of the separation roller to become lower value P1, leading to a state where the double-fed sheets S1 are extremely easy to be restored. At this point, the separation roller 53 starts to rotate in a restoring direction until the double-fed sheets S1 caused in the above-mentioned pre-feeding operation do not exist in the nip between the sheet feeding roller 51 and the separation roller 53, thereby avoiding the double-feed certainly.

At this moment, the sheet S (uppermost sheet) contacting with the sheet feeding roller 51 can be maintained in a stationary state due to the friction force of the sheet feeding roller 51 and the action of the one-way clutch 50. Further, in the state that only a single sheet is pinched by the nip between the sheet feeding roller 51 and the separation roller 53, the sheet feeding roller 51, the separation roller 53 and the sheet S can be maintained in a stationary state by the action of the one-way clutch 50 and the friction force between the sheet S and the sheet feeding roller 51 and between the sheet S and the separation roller 53.

When the rotation of the driving gear 80 is further advanced, the sheet feeding roller 51 starts the re-feeding operation, and at the same time, the pressure Pr of the separation roller is switched to be a high value P2 by the action of the pressure switching cam portion 80*f* and the pressure switching cam follower 93. Then, the conveyance of the sheet, temporarily stopped, is started to deliver the leading end of the sheet S to the pair of draw rollers 55. At this time, the pressure Pr of the separation roller 53 has been switched to be the higher value P2, so the stable re-feeding operation can be achieved.

Incidentally, in the re-feeding operation, the pressure Pr of the separation roller 53 tends to double-feed because of its higher value P2, but, after the sheet S is conveyed by a predetermined amount Lb by the re-feeding operation to deliver the leading end of the sheet S to the pair of draw rollers 55, the pressure Pr of the separation roller becomes the lower value P1 again by the action of the pressure switching cam portion 80*f*, with the result that the double-fed sheets can be surely restored before reaching to the pair of draw rollers 55. Thereafter, one revolution of the driving gear 80 is completed to stop the sheet feeding roller 51.

At this time, since the pair of draw rollers 55 continue to rotate, the sheet S is conveyed to the pair of register rollers 81. Here, the first toothless portion 80*a* of the driving gear 80 is opposed to the sheet feeding gear 65 during this drawing operation, and therefore the sheet feeding roller 51 is in an unloaded state. Thus, the sheet feeding roller 51 is subjected to the rotational force from the sheet S conveyed by the pair of draw rollers 55, with the result that the sheet feeding roller 51 is rotatingly driven (idling) until a trailing end of sheet S passes through the nip portion between the sheet feeding roller 51 and the separation roller 53.

If, in this drawing operation, a succeeding sheet S is driven to be fed, the separation roller driving shaft 54 rotates in a direction opposite to the sheet feeding direction during the operation of the pair of draw rollers 55, and the intermediate plate 70 is estranged from the sheet feeding roller 51, and furthermore, the pressure Pr of the separation roller 53 is smaller value P1, and as a result, at this point, the separation roller 53 starts to rotate reversely to be able to restore the double-fed sheets, thereby avoiding the double-feed certainly.

Due to the above operation, the leading end of the sheet S is conveyed toward the nip of the pair of register rollers 81 being stopped. The sheet detecting sensor 82 constituted of photo-interrupter or the like is disposed on an upstream side of the pair of register rollers 81 in the sheet feeding direction, and when the leading end of the sheet S is detected (Step 4), by timer means (not shown) provided in the CPU 40 for counting a time corresponding to the distance between the sensor 82 and the pair of register rollers 81, a signal for controlling the stop timing of the draw clutch 60 is issued so as to form a proper loop between the pair of draw rollers 55 and the pair of register rollers 81 (Step 6).

It is well known that such a loop is formed as means for correcting skew-feed of the sheet S. Further, by rotating the pair of register rollers 81 by an image leading end synchronous signal issued from the photosensitive drum 12 or an optical apparatus or the like for exposing the image, the sheet S is again conveyed onto the photosensitive drum 12, where a toner image is transferred onto the sheet. Then, when a predetermined time T2 (sec) is elapsed after the trailing end of the sheet S passes through the sheet detecting sensor 82 to ascertain that the trailing end of the sheet S surely passes through the nip of the pair of register rollers 81, a registration clutch 83 is turned OFF (Step 9, 10, 11). Incidentally, the sheet S to which the toner image has been transferred is sent to the fixing unit 22, where the image is fixed to the sheet, and then the sheet is delivered onto the delivery tray 25.

The same operations are repeated until the set number of the sheets to be treated for image formation is completed (Step 12), and after the set number of the sheets is completed, the draw clutch 60 is turned OFF (Step 13), and then the sheet feeding motor M1 and the draw motor M2 are respectively stopped (Step 14), and the whole procedure is ended.

As specifically mentioned above, by setting the pressure Pr of the separation roller 53 against the sheet feeding roller 51 to be higher value P2 in the pre-feeding operation, slip between the sheet feeding roller 51 and the sheet S during the pre-feeding is preventable, thereby carrying out stable pre-feeding operation. Further, since the pre-fed sheet S is temporarily stopped and the pressingly contacting operation of the sheets on the intermediate plate 70 with the sheet feeding roller 51 is released, and the pressure Pr of the separation roller 53 is set to be lower value P1, and, at this time, the restoring force by the separation roller 53 can be utilized, the sheet or sheets, if double-fed in the pre-feeding operation, can be surely restored, thereby effecting high reliable sheet feeding.

In addition, since variance in the position of the leading end of the sheet S, when the sheets supported on the intermediate plate 70 are released from pressing operation, can be minimized by stopping the pre-fed sheet S temporarily, the conveying distance from the position of the nip between the sheet feeding roller 51 and the separation roller 53 to the pair of draw rollers 55 can be shorten. Therefore, this can achieve miniaturization of the sheet feeding apparatus as a whole.

Also, when the sheet S is conveyed by the pair of draw rollers 55, since the sheet on the intermediate plate 70 is released from the pressingly contacting operation against the sheet feeding roller 51, the draw rollers of the pair of draw rollers are not subjected to conveying load due to pinching pressure generated when the intermediate plate 70 pushes the sheet feeding roller 51. Thus, the effect of prolonging the enduring lifetime of the draw rollers can be expected.

Further, in the initial state, since the intermediate plate 70 is estranged from the sheet feeding roller 51, the user, when setting the sheet bundle, performs this operation with no obstruction, and the user may merely hit the leading end of the sheet bundle against the hitting plate 78 for setting the sheets. Thus, since the operation is very easy, occurrence of sheet jam and skew-feed due to poor setting can be reduced.

In addition, the interlocking operation between the intermediate plate 70 and the sheet feeding roller 51 as well as the pressure switching operation of the separation roller 53 are effected by the driving gear 80 integrally formed with the pressing and estranging cam portion 80*c* for controlling the intermediate plate 70, two toothless portions 80*a*, 80*b*, and the pressure switching portion 80*f* for controlling the separation roller 53. A timing of pre-feeding the sheet, a timing of re-feeding the sheet, a timing of pressing and releasing from the pressing operation of the intermediate plate 70 against the sheet feeding roller 51, and a timing of switching the separation roller pressure are determined by the phase angles of the toothless portions 80*a*, 80*b*, the pressing and estranging cam portion 80*c* and the pressure switching cam portion 80*f*, and consequently, factors for causing dispersion are very few, thereby carrying out stable sheet feeding operation and separating operation with a low-cost structure.

Since the control for the rotation and stopping of the rotation of the sheet feeding roller 51 as well as for the pressure and release of the pressure of the intermediate plate 70 can be effected by one ON signal and one OFF signal for the solenoid 69, the control becomes very easy and the control accuracy is not severely required.

Further, since the pair of draw rollers 55 and the separation roller driving shaft 54 are synchronized and the control thereof is effected by the single draw clutch 60, not only the apparatus can be simplified but also such control can be effected independently from the rotation of the sheet feeding roller 51. Therefore, even in the state where the sheet feeding roller 51 is stopped, the restoring force by the separation roller 53 can be utilized, thereby providing the sheet feeding apparatus having high double-feed preventing ability.

(Second Embodiment)

Next, a multi-feeding section of the above-mentioned image forming apparatus as a second embodiment utilizing the present invention will be described in detail.

Figure 10:
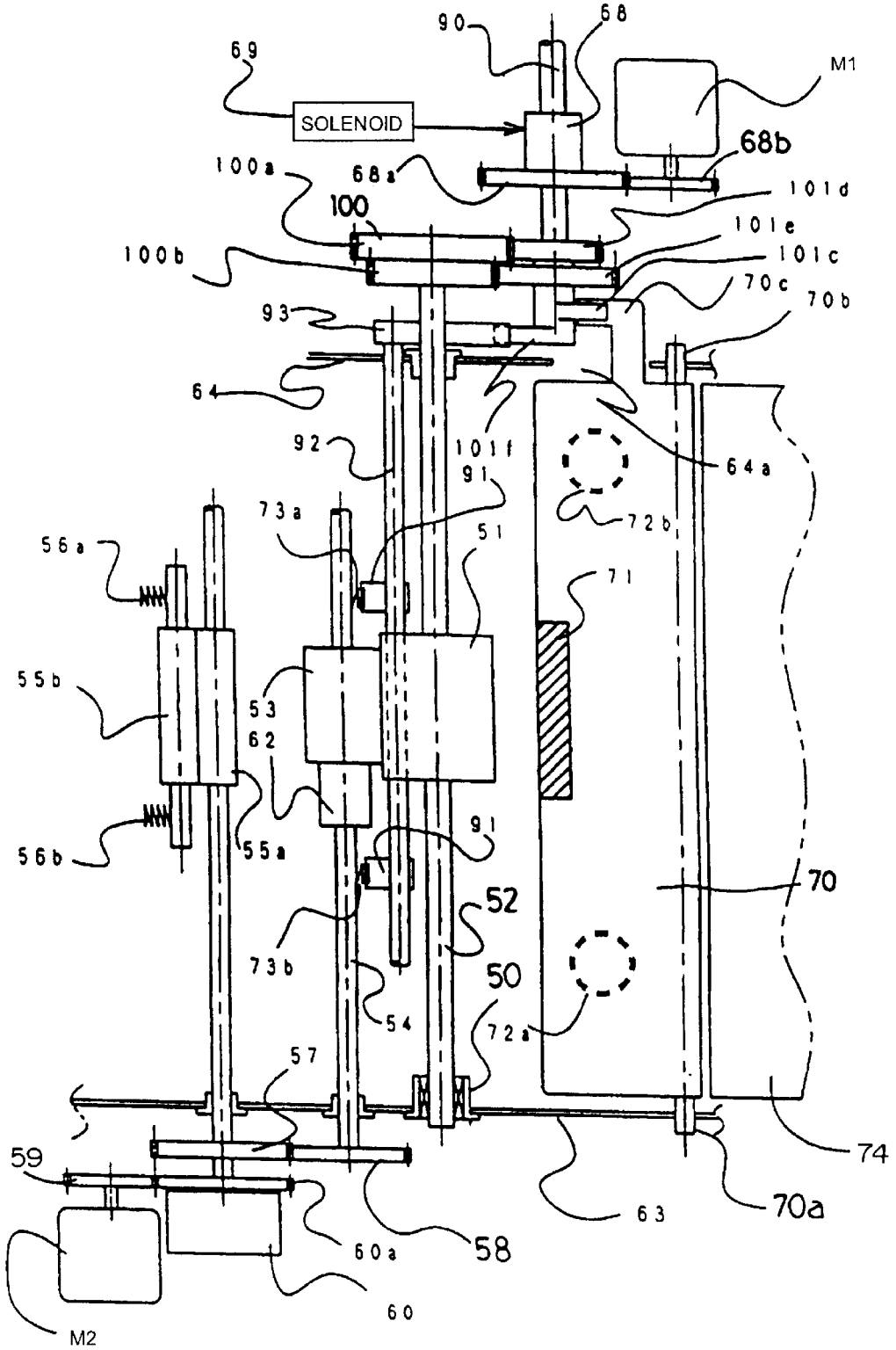
FIG. 10 is a drive development view of a multi-feeding section of a second embodiment according to the present invention.

FIG. 10 is a drive development view of a multi-feeding section according to the second embodiment. Incidentally, the members having the same configurations and the same functions as those in the above-mentioned first embodiment are designated by the same numerals, and explanation thereof will be omitted.

In the present embodiment, a sheet feeding driving stage gear 100 integrally constituted of a large diameter gear 100*a* and a small diameter gear 100*b* is secured to the rear end of the sheet feeding roller supporting shaft 52 of the sheet feeding roller 51.

In addition, there is provided, at a position to which the large diameter gear 100*a* and the small diameter gear 100*b* of the sheet feeding driving stage gear 100 as drive transmitting means are opposed for engagement, a driving gear 101, which is a stage gear, serving as drive transmitting means and having a first and a second segment gear portions 101*d*, 101*e* structured so as to be engageable with the respective large diameter gear 100*a* and the small diameter gear 100*b* and two non-engagement portions 101*a*, 101*b* which are not engaged with the sheet feeding driving stage gear 100. Further, a pressing and estranging cam portion 101*c* as pressing and estranging means for making the sheets supported on the intermediate plate 70 pressingly contacted or released from the pressingly contacting operation with respect to the sheet feeding roller 51 is integrally formed with the driving gear 101.

The pressing and estranging cam follower 70*c* is to be directly contacted with the pressing and estranging cam portion 101*c*, the pressing and estranging cam follower 70*c* being integrally formed at the rear side of the intermediate plate 70 and penetrating the hole 64*a* provided on the rear side plate 64 so as to extend to a position opposed and directly contacted with the pressing and estranging cam portion 101*c*. The driving gear 101 is secured to the driving shaft 90 having the spring clutch 68. The driving force of the sheet feeding motor M1 rotating at a predetermined speed is transmitted by turning ON the solenoid 69 for controlling the spring clutch 68 by a time of T1 (sec), with the result that one revolution of the spring clutch 68 at a predetermined rotating speed is controlled.

The phase angles of the spring clutch 68 and the non-engagement portion 101*a* are selected so that the non-engagement portion 101*a* of the driving gear 101 is positioned opposite to the sheet feeding driving stage gear 100, and with this arrangement, in an initial state, the sheet feeding driving stage gear 100, the roller shaft 52 and the sheet feeding roller 51 can be rotated in a sheet conveying direction with no load.

The driving gear 101 is provided with a pressure switching cam portion 101*f* serving as pressing force switching means, as described in the first embodiment, for switching the pressing force of the separation roller 53 against the sheet feeding roller 51. The pressure switching cam follower 93 for switching the pressure of the separation roller is directly contacted to a position opposed and directly contacted with the pressure switching cam portion 101*f*.

The pair of draw rollers 55 disposed on the downstream side of the sheet feeding roller 51 in the sheet conveying direction and such members as driving the rollers are the same as those in the aforementioned first embodiment, so the explanations thereof will be omitted. In addition, the torque limiter 62 provided in the separation roller driving shaft 54 is the same as that in the first embodiment, and the explanation thereof will be also omitted.

Incidentally, the rotating speed of the draw motor M2, the roller diameter of the sheet feeding roller 51 and the number of the teeth of the respective gears are selected so that, with a conveying speed of the pair of draw rollers 55 to be determined, the skew-feed of the sheet can be corrected by providing the pair of draw rollers on a further downstream side in the conveying direction and that the pair of draw rollers 55 can convey the sheet at a second conveying speed V2 substantially the same as the conveying speed of the pair of register rollers 81 which synchronizes with the toner images on the photosensitive drum.

Next, the structures of the sheet feeding roller 51, the separation roller 53 and the intermediate plate 70 will be described in detail with reference to FIGS from FIG. 11 to FIG. 14. As mentioned above, at a position to which the sheet feeding driving stage gear 100 is opposed for engagement, there is provided the driving gear 101 integrally constituted of the first and the second segment gear portions 101*d*, 101*e* engageable with the respective large diameter gear 100*a* and the small diameter gear 100*b* of the sheet feeding driving stage gear 100, the two non-engagement portions 101*a*, 101*b* which are not engaged with the sheet feeding driving stage gear 100, the pressing and estranging cam portion 101*c* for making the intermediate plate 70 pressingly contacted and released from the pressingly contacting operation with respect to the sheet feeding roller 51, and the pressure switching cam portion 101*f* for switching the pressure Pr of the separation roller 53 against the sheet feeding roller 51.

The phase angle of the spring clutch 68 and the configuration and position of the first non-engagement portion 101*a* are selected so that the first non-engagement portion 101*a* of the driving gear 101 is normally opposed to the sheet feeding driving stage gear 100, with the result that the sheet feeding roller shaft 52 is rotatable, but the rotation of the sheet feeding roller shaft 52 in the direction opposite to the sheet feeding direction is regulated by the action of the one-way clutch 50.

Figure 11:
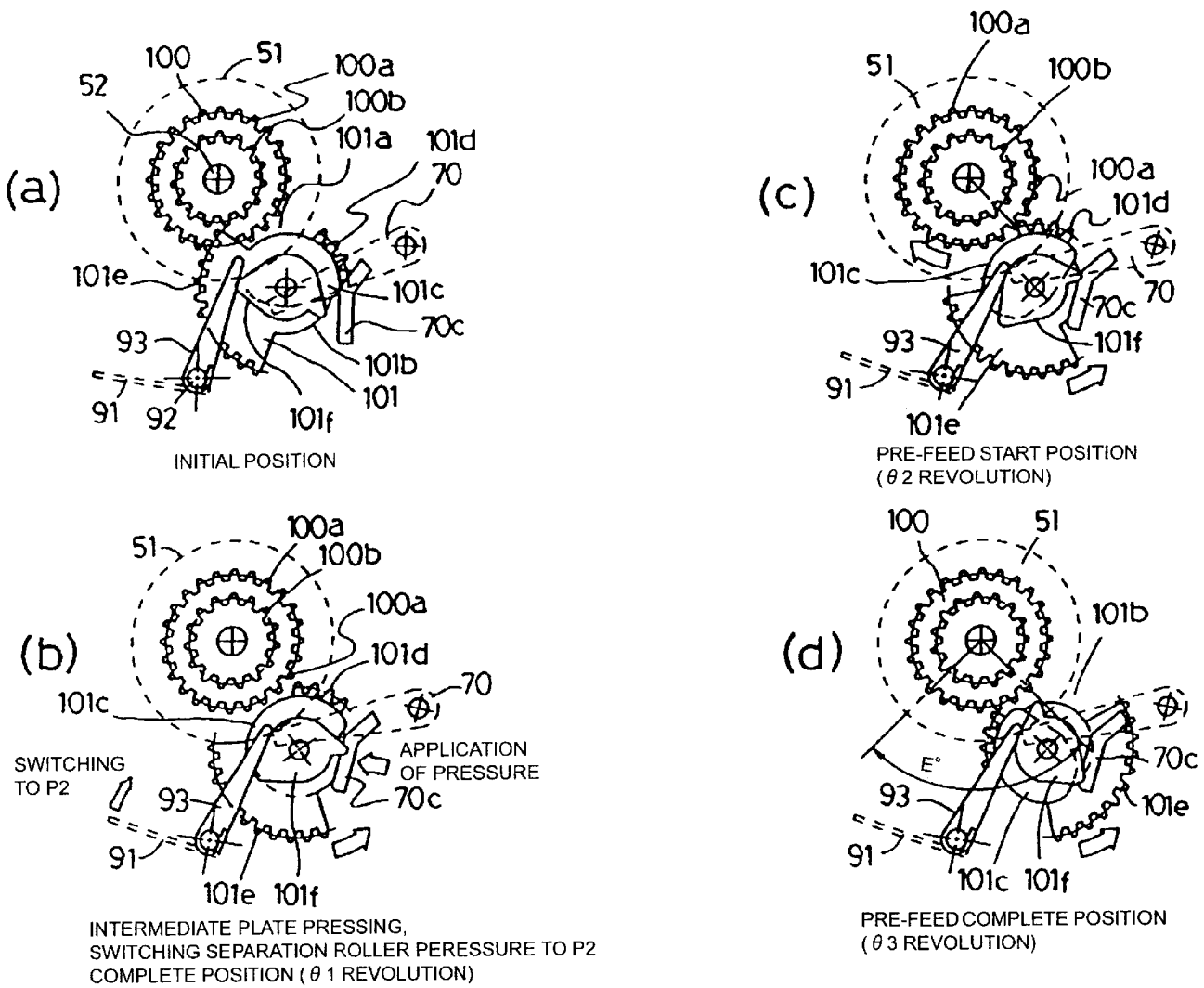
FIG. 11 is a view showing a state of operation of a driving gear of the second embodiment.

Next, the sheet feeding operation and the separating operation with the above configuration will be explained. From the initial state as shown in FIG. 11(*a*) and FIG. 13(*a*), the driving gear 101 starts rotating due to the action of the spring clutch 68 when the solenoid 69 is turned ON only by T1 (sec). The driving gear 101 starts rotating in a counter-clockwise direction in FIG. 11, and the pressing and estranging cam portion 101*c* is first rotated from an intermediate plate estranging position to an intermediate plate pressing position θ1. Accordingly, the pressure switching cam portion 101*f* for switching the separation roller pressure Pr is switched from the separation position to the sheet feeding position. Accordingly, the pressing and estranging cam follower 101*c* and the pressure switching cam follower 93 follow the outer peripheral forms of the respective cams, and as a result, the intermediate plate 70 is displaced so as to be pressed with the sheet feeding roller 51. Also, the pressure Pr of the separation roller is changed to be a higher value P2. Due to this operation, an uppermost sheet S of the sheet bundle stacked on the sheet feeding tray 74 is pressingly contacted with the sheet feeding roller 51 (state shown in FIG. 11(*b*) and FIG. 13(*b*)).

When the driving gear 101 is further rotated up to a position θ2, the first segment gear portion 101*d* provided in the driving gear 101 is then engaged with the large diameter gear portion 100*a* of the sheet feeding driving stage gear 100 to rotate the sheet feeding driving stage gear 100 only through a predetermined angle E°.

Incidentally, the sheet feeding motor M1, the outer diameter of the sheet feeding roller 51 and the number of teeth of the respective gears are selected so that the conveying speed of the sheet feeding roller 51 at this time becomes a first conveying speed V1 slower than a second conveying speed V2 of the pair of register rollers 81 or the pair of draw rollers 55. Following this rotation, the sheet feeding roller 51 is rotated only through the predetermined angle E° to feed out the uppermost sheet S of the sheet bundle by a predetermined amount L1 (this sheet feeding operation is referred to as "pre-feeding operation" hereinafter) (status in FIG. 11(*c*), (*d*) and FIG. 13(*c*), (*d*)).

Provided that an outer diameter of the sheet feeding roller 51 is D, a feeding amount L1 in the pre-feeding operation is represented by the following formula:

$$L1=E^{\circ}\times\pi\times D/360^{\circ} \quad \text{(Formula 3)}$$

Incidentally, the number of teeth of the first segment gear portion 101*d* is selected so that the sheet feeding amount L1 during the pre-feeding becomes greater than a distance La from the sheet hitting plate 78 to the nip formed by the sheet feeding roller 51 and the separation roller 53 and smaller than a distance Lb from the nip position to the pair of draw rollers 55. Then, when the driving gear 101 is further rotated up to a position θ3 until the second non-engagement portion 101*b* reaches at the position to which the sheet feeding driving stage gear 100 is opposed for engagement (status in FIG. 11(*d*), FIG. 13(*d*)), the driving force is not transmitted to the sheet feeding driving stage gear 100, thereby stopping the sheet feeding roller 51 temporarily.

Incidentally, since the number of teeth of the large diameter gear 100*a* or the first segment gear portion 101*d* is selected as mentioned above, regardless of the sheet feeding starting position of the sheet S, the leading end of the sheet fed by the amount L1 in the pre-feeding operation can surely be stopped temporarily between the nip and the pair of draw rollers 55

Thereafter, when the driving gear 101 is further rotated up to θ4 to return the cam portion 101*c* to the intermediate plate estranging position, the cam portion 101*c* is directly contacted with the cam follower 70*c*, with the result that the intermediate plate 70 is displaced so as to be estranged from the sheet feeding roller 51, and the sheets on the intermediate plate 70 are released from the pressingly contacting operation with respect to the sheet feeding roller 51. Approximately at the same time, the pressure switching cam portion 101*f* is switched to the separation position, and the pressure Pr of the separation roller 53 is switched to a lower value P1 (state shown in FIG. 12(*e*) and FIG. 14(*e*)).

The driving gear 101 is further rotated up to a position θ5 to switch the pressure switching cam portion 101*f* to the sheet feeding position, and the pressure Pr of the separation roller 53 is returned to the higher value P2. Therefore, as mentioned above, the pressure Pr of the separation roller 53 with respect to the sheet feeding roller 51 can be kept in the lower value P1 while the driving gear 101 is rotated from θ4 to θ5.

Figure 12:
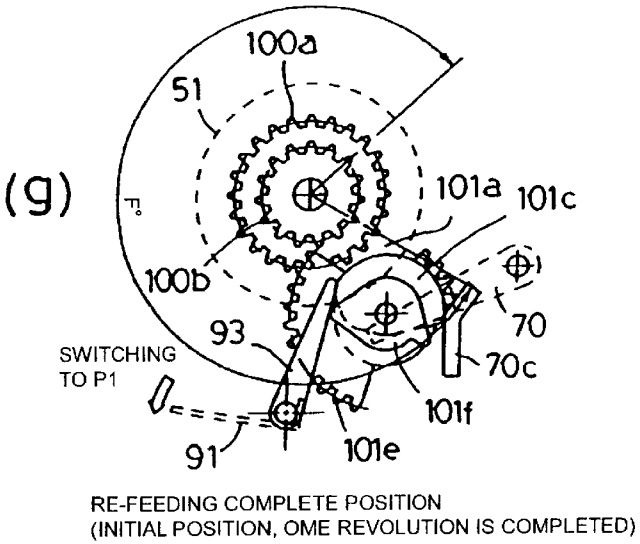
FIG. 12 is a view showing a state of operation of the driving gear of the second embodiment.
Figure 12:
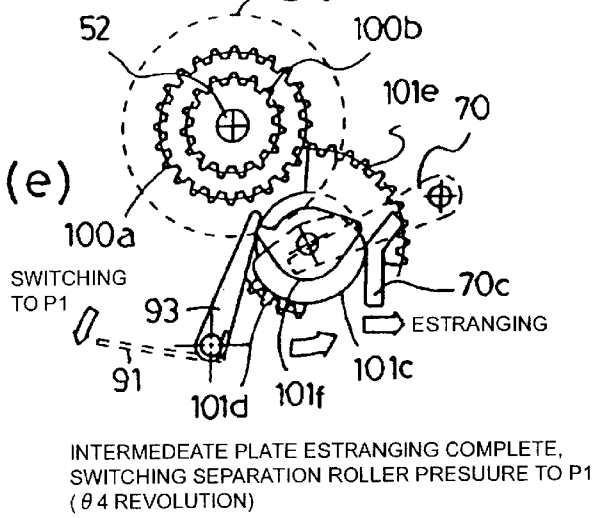
Figure 12:
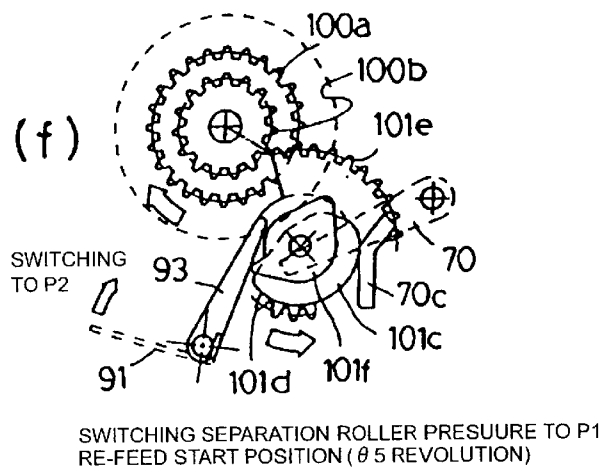
Figure 13:
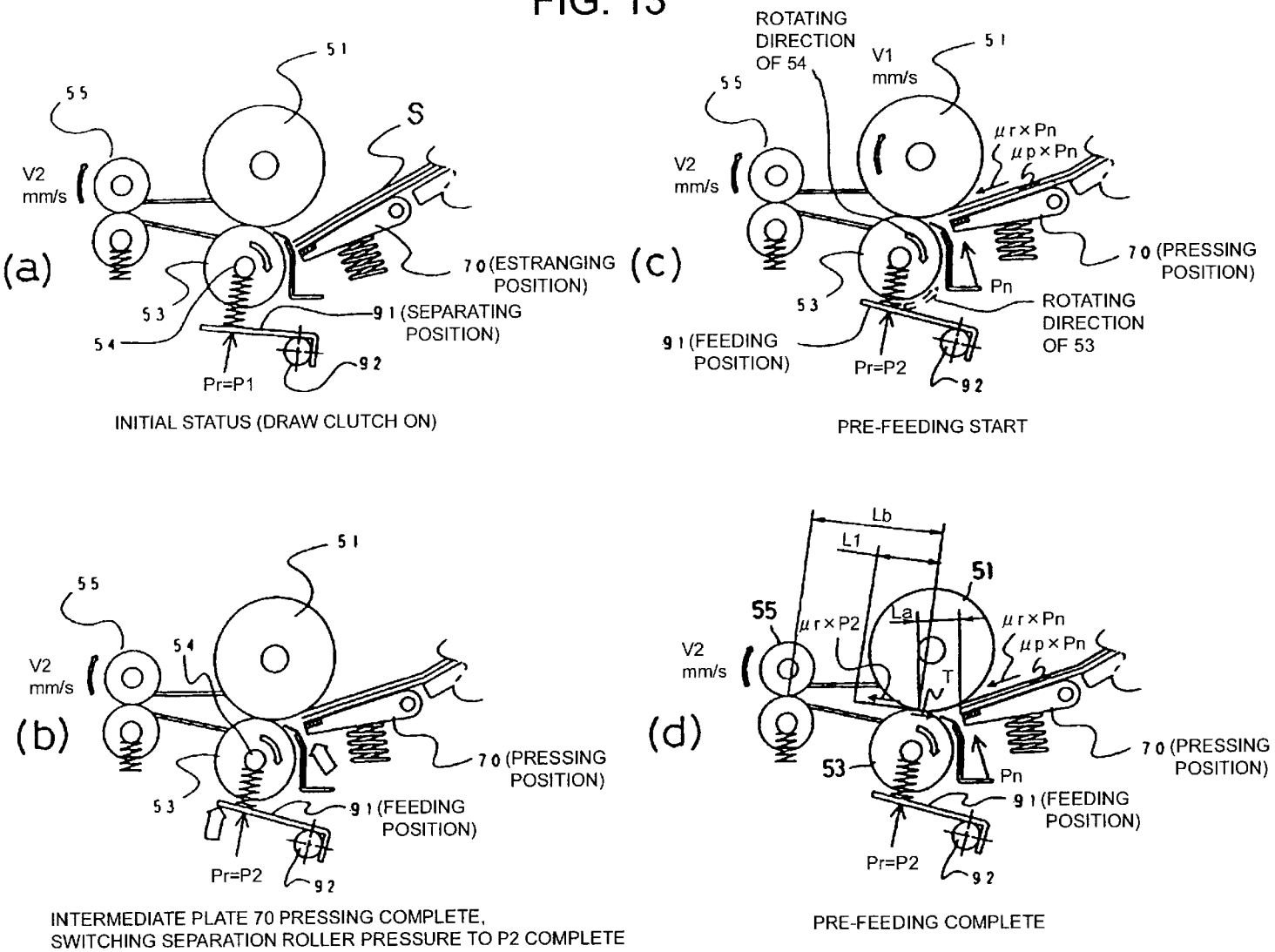
FIG. 13 is a view showing a state of operation of a multi-feeding section of the second embodiment.
Figure 14:
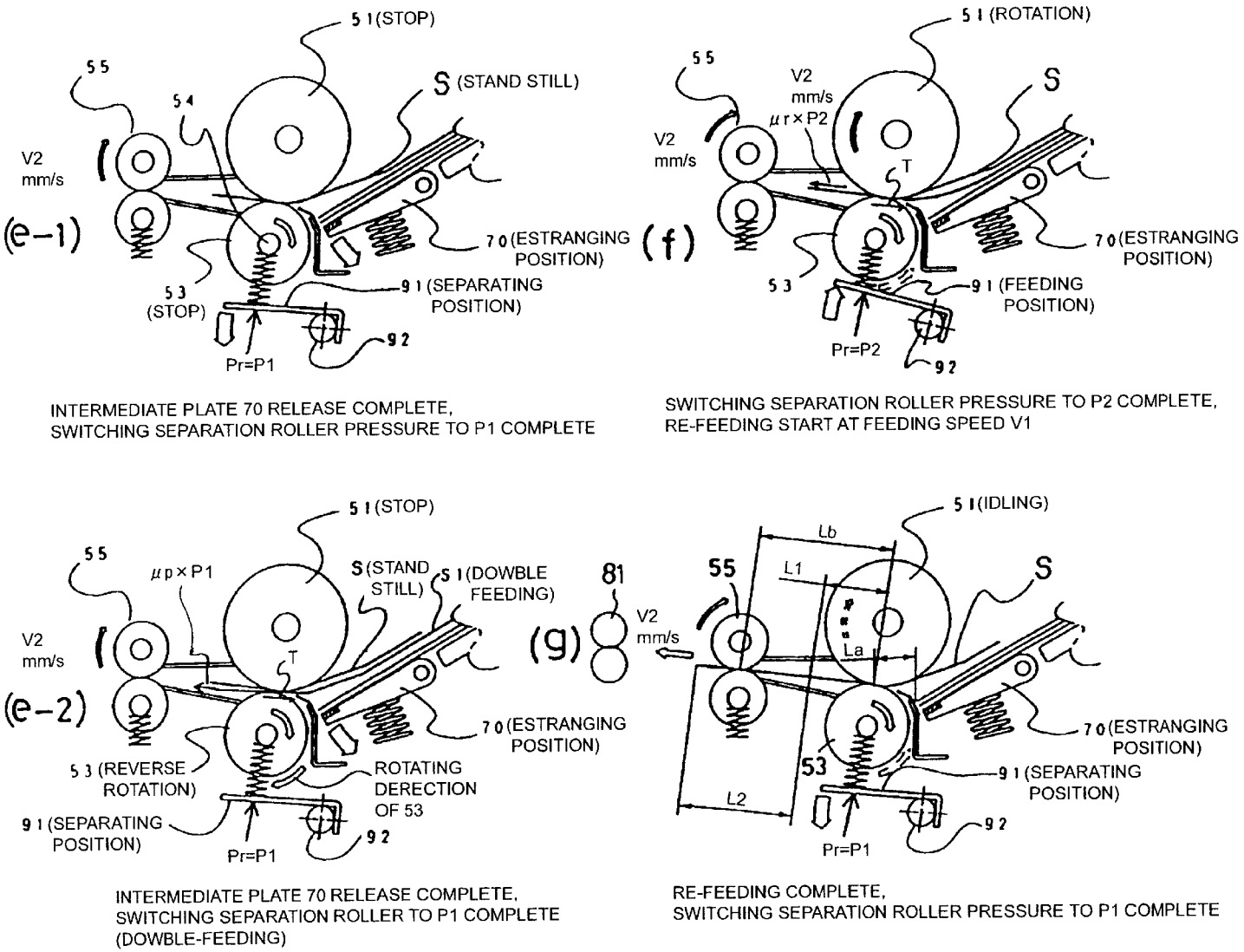
FIG. 14 is a view showing a state of operation of the multi-feeding section of the second embodiment.

Then, engagement of the second segment gear portion 101*e* of the driving gear 101 with the small diameter gear portion 100*b* of the sheet feeding driving stage gear 100 (status in FIG. 12(*f*) and FIG. 14(*f*)) allows the sheet feeding driving stage gear 100 to resume the rotation to rotate only at a predetermined angle F, and following this rotation, the sheet feeding operation by the sheet feeding roller 51 is resumed. (the sheet feeding operation after pre-sheet feeding operation is referred to as "re-feeding" hereinafter).

The feeding amount L2 by the sheet feeding roller 51 at this time becomes:

$$L2=F^{\circ}\times\pi\times D/360^{\circ} \quad \text{(Formula 4)}$$

Incidentally, the number of teeth of the second segment gear portion 101*e* is selected so that a feeding amount L2 becomes an amount which can surely bring the leading end of the sheet fed in front of the pair of draw rollers 55 in the pre-feeding operation at least to the pair of draw rollers 55 as well as an amount which does not reach the pair of register rollers 81.

The outer diameter of the sheet feeding roller 51, the rotating number of the sheet feeding motor M1, the number of teeth of the respective gears, and the like are selected so that the second conveying speed V2 of the sheet feeding roller 51 at this moment becomes the same as the conveying speed by the pair of register rollers 51 or the pair of the draw rollers 55.

The rotation of the driving gear 101 is further advanced, and when the first non-engagement portion 101*a* reaches at the position to which the small diameter gear portion 100*b* of the sheet feeding driving stage gear 100 is opposed, the sheet feeding driving stage gear 100 does not receive the driving force, thereby stopping the rotation of the sheet feeding roller 51. Then, the driving gear 101 finishes rotating to stop at the initial position (state shown in FIG. 12(*g*) and FIG. 14(*g*)).

Figure 15:
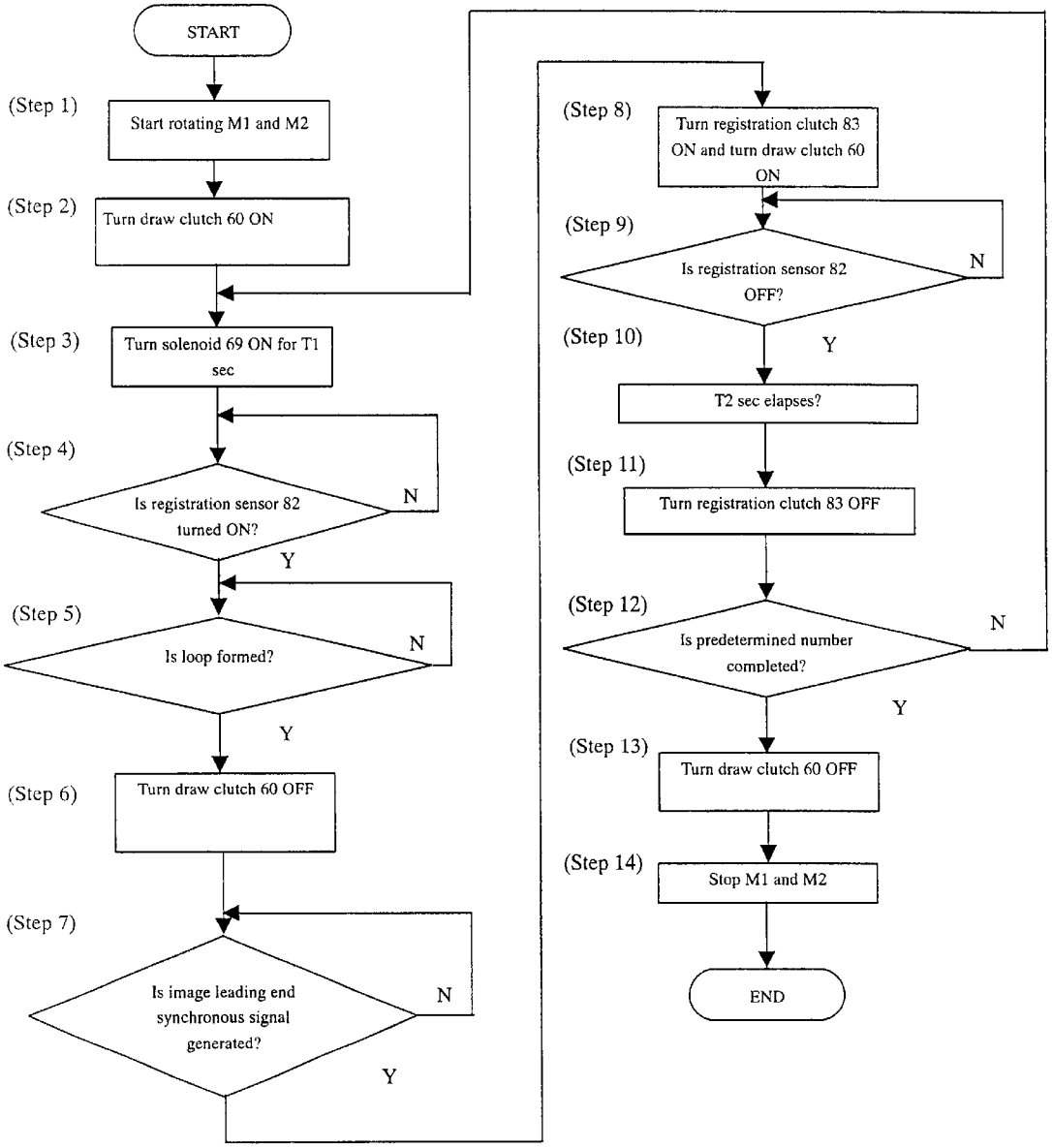
FIG. 15 is an operation flowchart during the sheet feeding of the second embodiment.
Figure 16:
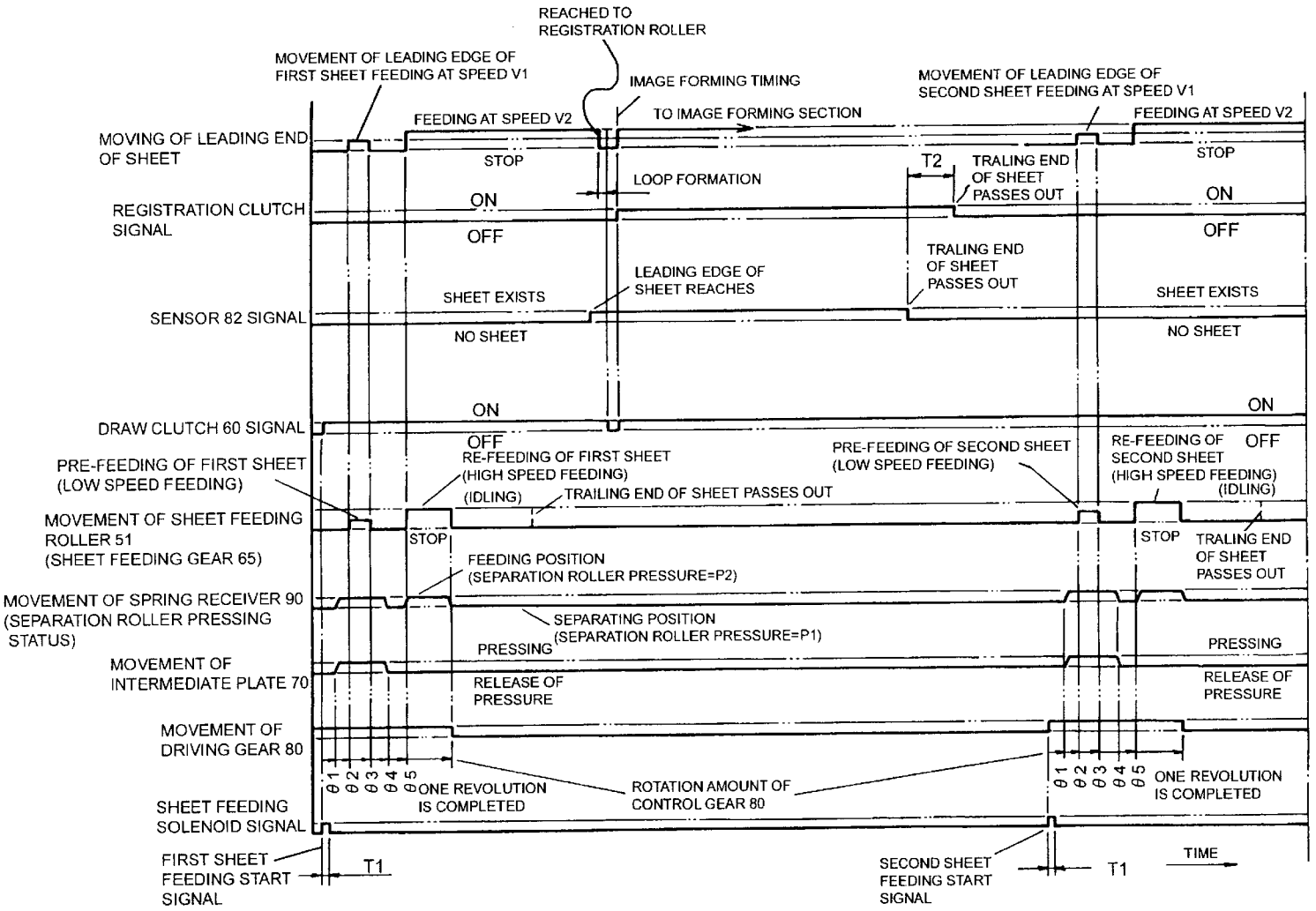
FIG. 16 is an operation timing chart during the sheet feeding of the second embodiment.

Next, the sheet feeding operation from the multi-feeding section will be explained with reference to a flowchart shown in FIG. 15 and a timing chart shown in FIG. 16.

In a state that the sheet bundle is stored on the sheet feeding tray 74, when a start button (not shown) is pressed, the draw motor M2 and the sheet feeding motor M1 start to rotate respectively (step 1), and an ON signal of the draw clutch 60 is issued from a CPU 40 (step 2). As a result, as mentioned above, the pair of draw rollers 55 start to rotate at the first conveying speed V1 in the sheet conveying direction, and the separation roller driving shaft 54 is rotated in a direction opposite to the sheet conveying direction, and the separation roller 53 is provided with a determined restoring force by torque generated by the torque limiter 62. However, the separation roller 53 stays still due to friction force with the sheet feeding roller 51 where the rotation in the reverse direction is regulated by the action of the one-way clutch 50.

Next, after a predetermined time period is elapsed, a signal from the CPU 40 turns ON the solenoid 69 (Step 3) to start the control of one revolution of the driving gear 101. By this operation, as fully mentioned above, the intermediate plate 70 is first displaced so as to be pressed with the sheet feeding roller 51, and the supported sheets are pressingly contacted with the sheet feeding roller 51. At the same time, the pressure Pr of the separation roller becomes higher value P2. Next, the sheet feeding roller 51 is rotated only through a predetermined angle E° to feed out the uppermost sheet S by a predetermined amount L1 at the first conveying speed V1 due to the pressure of the intermediate plate 70 and the friction force of the surface of the sheet feeding roller 51 (pre-feeding operation).

At this moment, the separation roller 53 is driven to rotate in a sheet feeding direction because of the rotation of the sheet feeding roller 51. By the way, in the above-mentioned pre-feeding operation, if two or more sheets are fed together in an overlapped state (what is called double-feed), the separation roller 53 tries to operate so as to restore the double-fed sheets S1, but at this time, since the intermediate plate 70 is pressed with the sheet feeding roller 51 by the intermediate plate spring 72, the separating operation by the separation roller 53 may be obstructed and the double-fed sheets S1 may not be restored.

However, when the driving gear 101 is further rotated, the sheet feeding roller 51 is stopped temporarily, and thereafter, the intermediate plate 70 is released from the pressingly contacting operation against and estranged from the sheet feeding roller 51 by the action of the pressing and estranging cam portion 101*c* and the pressing and estranging cam follower 70*c*, and also the pressure Pr of the separation roller 53 is switched to the lower value P1 by the action of the pressure switching cam portion 101*f* and the pressure switching cam follower 93.

As mentioned above, since the first conveying speed V1 in the pre-feeding operation is set to be slower than the second conveying speed V2 of the pair of register rollers 81 or the pair of draw rollers 55, the double-feed is hard to occur, and slip at the sheet feeding roller 51, or the like is also hard to occur in the pre-feeding operation, thereby carrying out stable sheet feeding operation.

In addition, since the pre-feeding operation is carried out at the speed which hardly generates the slip as mentioned above, the pressure applied by the intermediate plate 70 with respect to the sheet feeding roller 51 can be set lower than the conventional pressure. Because of this, the occurrence of the double-feed is further difficult. Incidentally, if the double-feed occurs, the double-fed sheets can be released from the binding force because, at this time, the turned-ON state of the draw clutch 60 is maintained so that the separation roller driving shaft 54 continues to rotate in the direction opposite to the sheet conveying direction, and also the intermediate plate 70 is released from the pressingly contacting operation.

At this point, the separation roller 53 starts to rotate in a restoring direction until the double-fed sheets caused in the pre-feeding operation do not exist in the nip between the sheet feeding roller 51 and the separation roller 53, thereby avoiding the double-feed certainly. Incidentally, in a state that only a single sheet is pinched by the nip between the sheet feeding roller 51 and the separation roller 53, the sheet feeding roller 51, the separation roller 53, and sheet S can be maintained in a stationary state by the action of the one-way clutch 50 and the friction force between the sheet S and the sheet feeding roller 51 and between the sheet S and the separation roller 53.

When the rotation of the driving gear 101 is further advanced, the sheet feeding roller 51 starts the re-feeding operation to resume the conveyance, at the second conveying speed V2, of the sheet S which has been stopped temporarily, with the result that the leading end of the sheet S is delivered to the pair of draw rollers 55 rotating at the second conveying speed V2. Then, after a predetermined amount Lb is conveyed by the sheet feeding roller 51 in the re-feeding operation, the driving gear 101 finishes the control of one revolution. Although the sheet feeding roller 51 is stopped, the sheet S is conveyed to the pair of register rollers 81 because the pair of draw rollers 55 continue to rotate.

At this time, since the first non-engagement portion 101*a* of the driving gear 101 is opposed to the sheet feeding driving stage gear 100, the sheet feeding roller 51 is in an unloaded state. Thus, the sheet feeding roller 51 is subjected to the rotational force from the sheet S conveyed by the pair of draw rollers 55, with the result that the sheet feeding roller 51 is rotatingly driven (idling) until a trailing end of sheet S passes through the nip portion between the sheet feeding roller 51 and the separation roller 53.

During this drawing operation, the double-feed is hard to occur because the intermediate plate 70 is estranged from the sheet feeding roller 51 and a succeeding sheet to be fed is not subjected to the friction force from the sheet S being drawn, but if the succeeding sheet is driven to be fed, the separation roller driving shaft 54, during the operation of the pair of draw rollers 55, rotates in a direction opposite to the sheet conveying direction, and also the intermediate plate 70 is released from the pressing operation against the sheet feeding roller 51 so the supported sheet are released from the pressing operation, with the result that the separation roller 53, at this point, starts to rotate reversely to restore the double-fed sheets, thereby surely avoiding the double-feed.

Due to the above operation, the leading end of the sheet S is conveyed toward the nip of the pair of register rollers 81 being stopped. The sheet detecting sensor 82 constituted of photo-interrupter or the like is disposed on an upstream side of the pair of register rollers 81, and when the leading end of the sheet S is detected (Step 4), by timer means (not shown) provided in the CPU 40 for counting a time corresponding to the distance between the sensor 82 and the pair of register rollers 81, a signal for controlling the stop timing of the draw clutch 60 is issued so as to form a proper loop between the pair of draw rollers 55 and the pair of register rollers 81 (Step 6).

It is well known that such a loop is formed as means for correcting skew-feed of the sheet S. Further, by rotating the pair of register rollers 81 by an image leading end synchronous signal issued from the photosensitive drum 12 or an optical device or the like for exposing the image, the sheet S is again conveyed at the second conveying speed V2 to be fed onto the photosensitive drum 12 rotating at the second conveying speed V2, where a toner image is transferred onto the surface of the sheet.

Then, when a predetermined time T2 (sec) is elapsed after the trailing end of the sheet S passes through the sheet detecting sensor 82 to ascertain that the trailing end of the sheet S surely passes through the nip of the pair of register rollers 81, the registration clutch 83 is turned OFF (Step 9, 10, 11). Incidentally, the sheet S to which the toner image has been transferred is sent to the fixing unit 22, where the image is fixed to the sheet, and then the sheet is delivered onto the delivery tray 25. The same operations are repeated until the set number of the sheets to be treated for image formation is completed (Step 12), and after the set number of the sheets is completed, the draw clutch 60 is turned OFF (Step 13), and then the sheet feeding motor M1 and the draw motor M2 are respectively stopped (Step 14), and the whole procedure is ended.

As specifically mentioned above, in the second embodiment according to the present invention, the first conveying speed V1 in the pre-feeding operation is slower than the second conveying speed V2 of the pair of draw rollers 55 or the pair of register rollers 81, so the double-feed is hard to occur.

Further, since the pressure Pr of the separation roller 53 against the sheet feeding roller 51 is set to be the higher value P2 in the pre-feeding operation, slip between the sheet feeding roller 51 and the sheet S, or the like hardly occurs, thereby carrying out stable pre-feeding operation.

Also, since the pre-fed sheet S is temporarily stopped and the sheets on the intermediate plate 70 are released from pressingly contacting operation with the sheet feeding roller 51, and the pressure Pr of the separation roller 53 is set to be lower value P1, and, at this time, the restoring force by the separation roller 53 can be utilized, the sheet or sheets double-fed in the pre-feeding operation, can be surely restored, thereby effecting high reliable sheet feeding.

Furthermore, since the configuration is made to further prevent the double-feed as mentioned above, torque value of the torque limiter 62 (sheet restoring force by the separation roller 53) can be set smaller. Also, the occurrence of the slip in the pre-feeding operation can be reduced, so the pressing force of the intermediate plate 70 against the sheet feeding roller 51 can be set to a smaller value, with the result that the enduring lifetime of the sheet feeding roller 51 or the separation roller 53 can be improved. Thus, a sheet feeding apparatus having a low maintenance cost can be provided.

Since variance in the position of the leading end of the sheet S, when the intermediate plate 70 is released from pressure, can be minimized by stopping the pre-fed sheet S temporarily, the conveying distance from the position of the nip between the sheet feeding roller 51 and the separation roller 53 to the pair of draw rollers 55 can be shorten. Therefore, this can achieve miniaturization of the sheet feeding apparatus as a whole.

In addition, when the sheet S is conveyed by the pair of draw rollers 55, since the intermediate plate 70 has already been estranged from the sheet feeding roller 51, the draw rollers of the pair of draw rollers 55 are not subjected to conveying load by the intermediate plate pressure, thereby improving the enduring lifetime of the draw rollers.

Further, in the initial state, since the intermediate plate 70 is estranged from the sheet feeding roller 51, the user, when setting the sheet bundle, performs this operation with no obstruction, and the user may merely hit the leading end of the sheet bundle against the hitting plate 78 for setting the sheets. Therefore, since the operation is very easy, occurrence of sheet jam due to poor setting can be reduced.

In addition, the interlocking operation between the intermediate plate 70 and the sheet feeding roller 51 as well as the pressure switching operation of the separation roller 53 are effected by the driving gear 101 integrally formed with the pressing and estranging cam portion 101*c* for controlling the intermediate plate 70, two non-engagement portions 101*a*, 101*b*, and the pressure switching portion 101*f* for controlling the separation roller 53. A timing of pre-feeding the sheet, a timing of re-feeding the sheet, a timing of pressing and releasing from the pressing operation of the intermediate plate 70 against the sheet feeding roller 51, and a timing of switching the separation roller pressure are determined by the phase angles of the non-engagement portions 101*a*, 101*b*, the pressing and estranging cam portion 101*c* and the pressure switching cam portion 101*f*, and consequently, factors for causing dispersion are very few, thereby carrying out stable sheet feeding operation and separating operation with a low-cost structure.

Since the control for the rotation and stopping of the rotation of the sheet feeding roller 51 as well as for the pressure and release of the pressure of the intermediate plate 70 can be effected by one ON signal and one OFF signal for the solenoid 69, the control becomes very easy and the control accuracy is not severely required.

Further, since the pair of draw rollers 55 and the separation roller driving shaft 54 are synchronized and the control thereof is effected by the single draw clutch 60, not only the apparatus can be simplified but also such control can be effected independently from the rotation of the sheet feeding roller 51. Therefore, even in the state where the sheet feeding roller 51 is stopped, the restoring force by the separation roller 53 can be utilized, thereby providing the sheet feeding apparatus having high double-feed preventing ability.

(Third Embodiment)

Next, a multi-feeding section of the above-mentioned image forming apparatus as a third embodiment utilizing the present invention will be described in detail.

Figure 17:
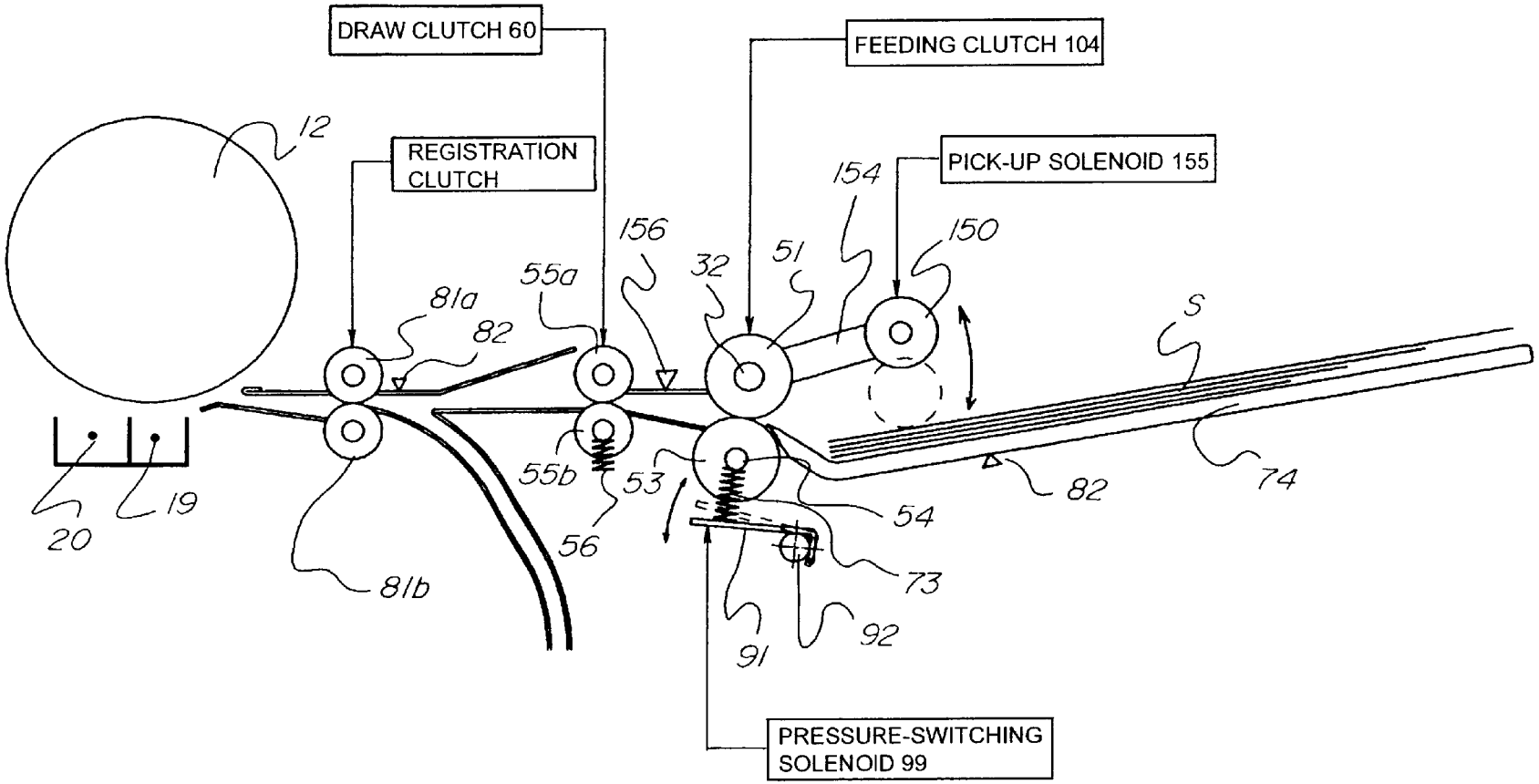
FIG. 17 is a sectional view of an essential portion of a multi-feeding section of a third embodiment according to the present invention.

FIG. 17 is a schematic structural view of a multi-feeding section according to a third embodiment. Incidentally, the members having the same configurations and the same functions as those in the above-mentioned first and second embodiments are designated by the same numerals, and explanation thereof will be omitted.

Although it is characterized in the previous embodiments that feeding operation of sheets stacked and supported on the intermediate plate 70 of the sheet feeding tray 74 is carried out by making the intermediate plate 70 pressed and released from the pressing operation with respect to the sheet feeding roller 51, but in this embodiment, a pick-up roller 150 serving as feeding means and swinging so as to be pressingly contacted with and estranged from the sheets stacked on the sheet feeding tray 74 is provided without an intermediate plate, providing a type of sheet feeding apparatuses where a sheet is fed to the nip portion formed by the sheet feeding roller 51 and the separation roller 53 by the sheet feeding operation of this pick-up roller 150.

Figure 18:
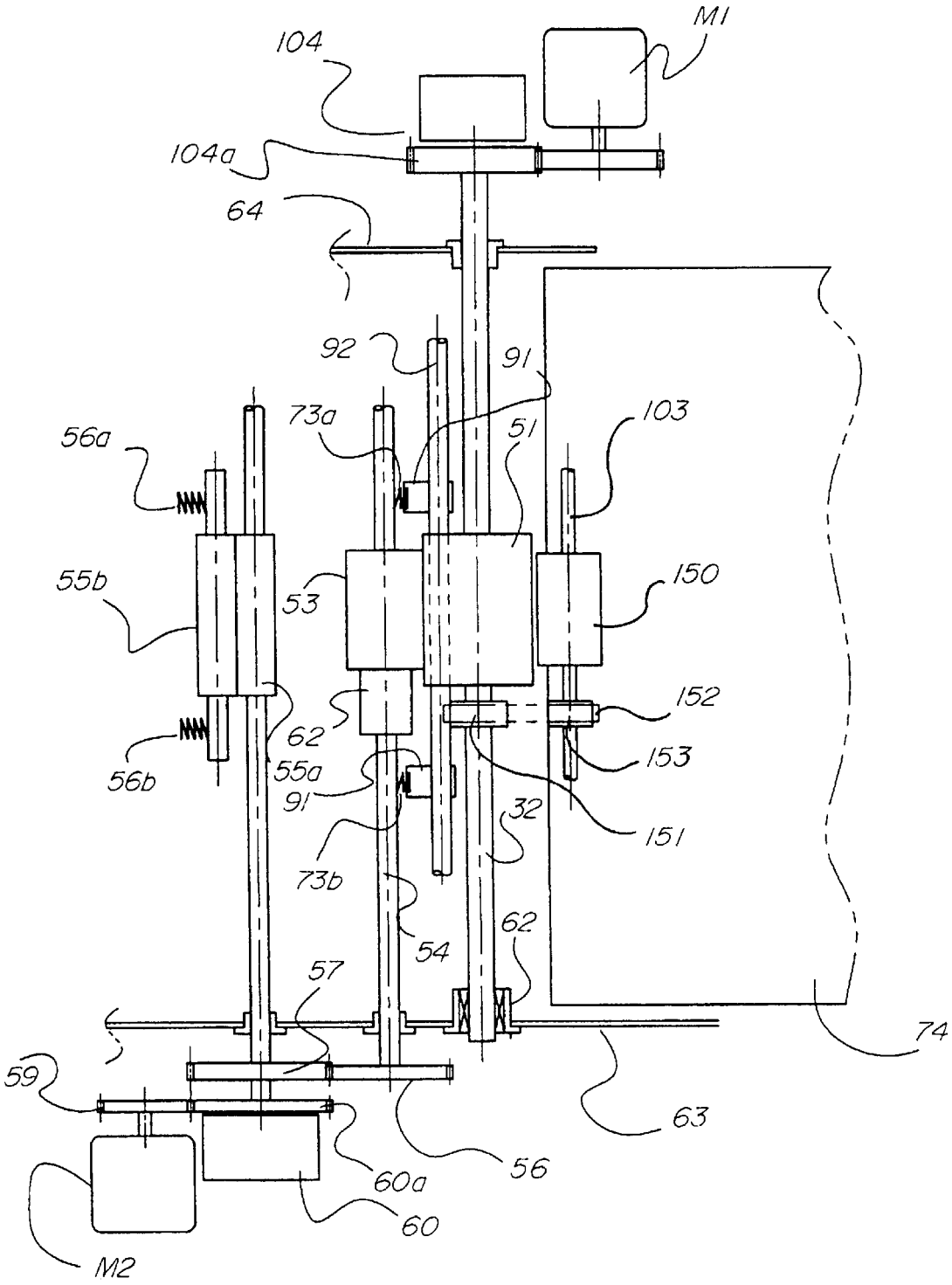
FIG. 18 is a drive development view of the multi-feeding section of the third embodiment.

A sheet feeding apparatus of the present embodiment will be specifically described hereinafter with reference to drive development views FIG. 17 and FIG. 18.

The sheet feeding roller 51 is secured to the sheet feeding roller supporting shaft 52, and the supporting shaft 52 is pivotally supported by the front and rear side plates 63, 64, but the supporting shaft 52 is so structured not to be rotated reversely (in a counterclockwise direction in FIG. 17) by the action of the one-way clutch 50.

On the rear end of the sheet feeding roller supporting shaft 52, a sheet feeding driving clutch 104 is pivotally supported, so the sheet feeding roller 51 is rotatable in a sheet conveying direction (clockwise direction in FIG. 17) by the rotation of the sheet feeding motor M1 and the turning ON of the sheet feeding driving clutch as a drive transmitting means. Incidentally, the sheet feeding roller 51 has a structure that, when the sheet feeding driving clutch 104 is turned OFF, the sheet feeding roller supporting shaft 52 can rotate in the sheet conveying direction with no load.

Numeral 150 refers to the pick-up roller for picking up the sheets on the sheet feeding tray 74, and the pick-up roller 150 is pivotally supported on a pick-up roller shaft 103. In addition, a pulley 151 and a pulley 152 are pivotally supported respectively on the supporting shaft 52 and on the pick-up roller shaft 103.

The pulleys 151, 152 are suspended on a driving belt 153, and it is so structured that the sheet feeding roller supporting shaft 52 and the pick-up roller shaft 103 are synchronized to be able to rotate. In addition, outer diameters of the sheet feeding roller and the pick-up roller and the number of teeth of each of the pulleys are selected so that circumferential speed of the sheet feeding roller 51 is approximately the same as that of the pick-up roller 150.

The pick-up roller 150 is supported so as to be swung by a roller arm 154 on the sheet feeding roller supporting shaft 52 as a rotary fulcrum, and the position of the pick-up roller 150 can be moved to a escaping position (solid line position in FIG. 17) where the pick-up roller 150 is estranged from an uppermost sheet S stacked on the sheet feeding tray 74, by turning OFF a pick-up solenoid 155 as a pressing and estranging means, or can be moved to a sheet feeding position (broken line position in FIG. 17) where the pick-up roller 150 is pressurized by its own weight, by turning ON the pick-up solenoid 155.

The weights of the roller arm 154, the pick-up roller 150 and the like are selected so that, when the pick-up roller 150 is in the sheet feeding position, pressure of the pick-up roller 150 with respect to the sheet S becomes Pn.

A sheet detecting sensor 156 for detecting the sheet S is arranged on a downstream side of the sheet feeding roller 51 in a sheet conveying direction, and on the further downstream side of the sheet detecting sensor 156, the pair of draw rollers 55 for further conveying the sheet fed out by the sheet feeding roller 51 is provided. Since the structure and the drive transmitting route of the pair of draw rollers 55 are the same as those in the aforementioned embodiments, explanation thereof will be omitted.

The separation roller 53 to which the rotation, with a predetermined restoring force, in a direction opposite to the sheet feeding direction is transmitted is provided in a position opposite to the sheet feeding roller 51, and the separation roller 53 is pressingly contacted with the sheet feeding roller 51. The torque limiter 62 is provided intermediately on the separation roller driving shaft 54 which pivotally supports the separation roller 53. Also, respective springs 73*a*, 73*b* are provided via bearings (not shown) at one end of the separation roller 53 so as to press the separation roller 53 to the direction of the sheet feeding roller 51.

At the other end of the springs 73*a*, 73*b*, there is provided the spring receiver 91. This spring receiver 91 is secured to the rotating shaft 92 having a rotary center so as to be displaced according to the turning ON and OFF operation of a pressure switching solenoid 99. The position of the spring receiver 91 is switched by the action of the pressure switching solenoid 99. In other words, in a state where the pressure switching solenoid 99 is turned OFF, the spring receiver 91 is maintained in the solid line position in FIG. 17 (the pressure Pr in this position referred to as P1) and, on the other hand, by turning ON the pressure switching solenoid 99, the spring receiver 91 is displaced to the broken line position in FIG. 17 (the pressure Pr in this position referred to as P2). Thus, the pressure (separating pressure) of the separation roller 53 with respect to the sheet feeding roller 51 can be switched. Incidentally, the pressure Pr is P1<P2.

The control of the multi-feeding section of the present embodiment will be explained with reference to views showing sheet feeding operation in FIG. 19 and FIG. 20 and an operation flowchart in FIG. 21.

First, the motors M1, M2 start driving. In this situation, the sheet feeding driving clutch 104 is turned OFF, and the draw clutch 60 is turned ON. Because of this, the pair of draw rollers 55 and the separation roller shaft 54 starts to rotate. In this state, the sheet feeding roller supporting shaft 52 is rotatable, but the rotation in a direction opposite to the sheet feeding direction is regulated by the action of the one-way clutch 50, and therefore, the sheet feeding roller 51 stops, and the separation roller 53, which pressingly contacts with the sheet feeding roller 51, also stops rotating.

Figure 19:
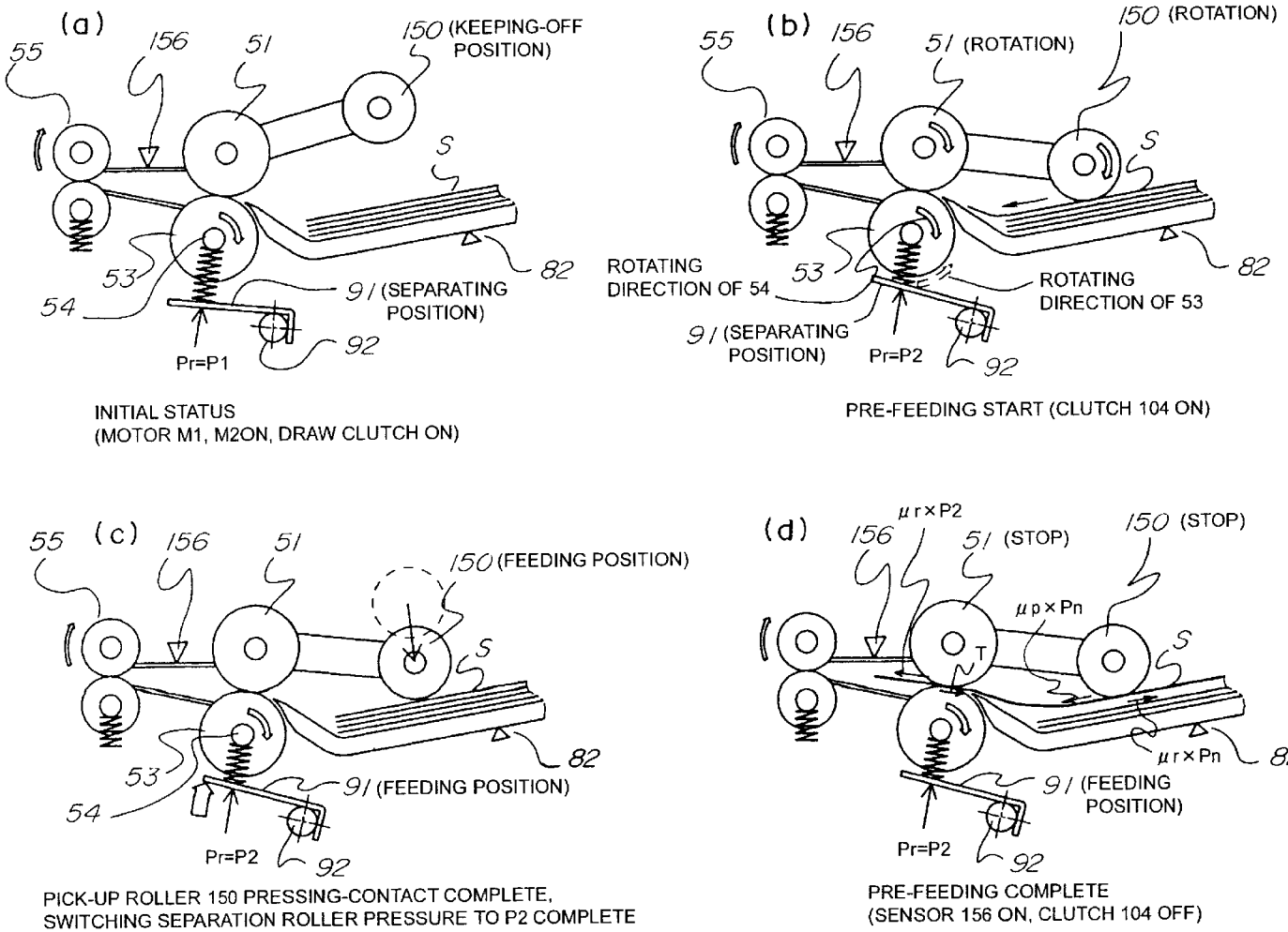
FIG. 19 is a view showing a state of operation of the multi-feeding section of the third embodiment.
Figure 20:
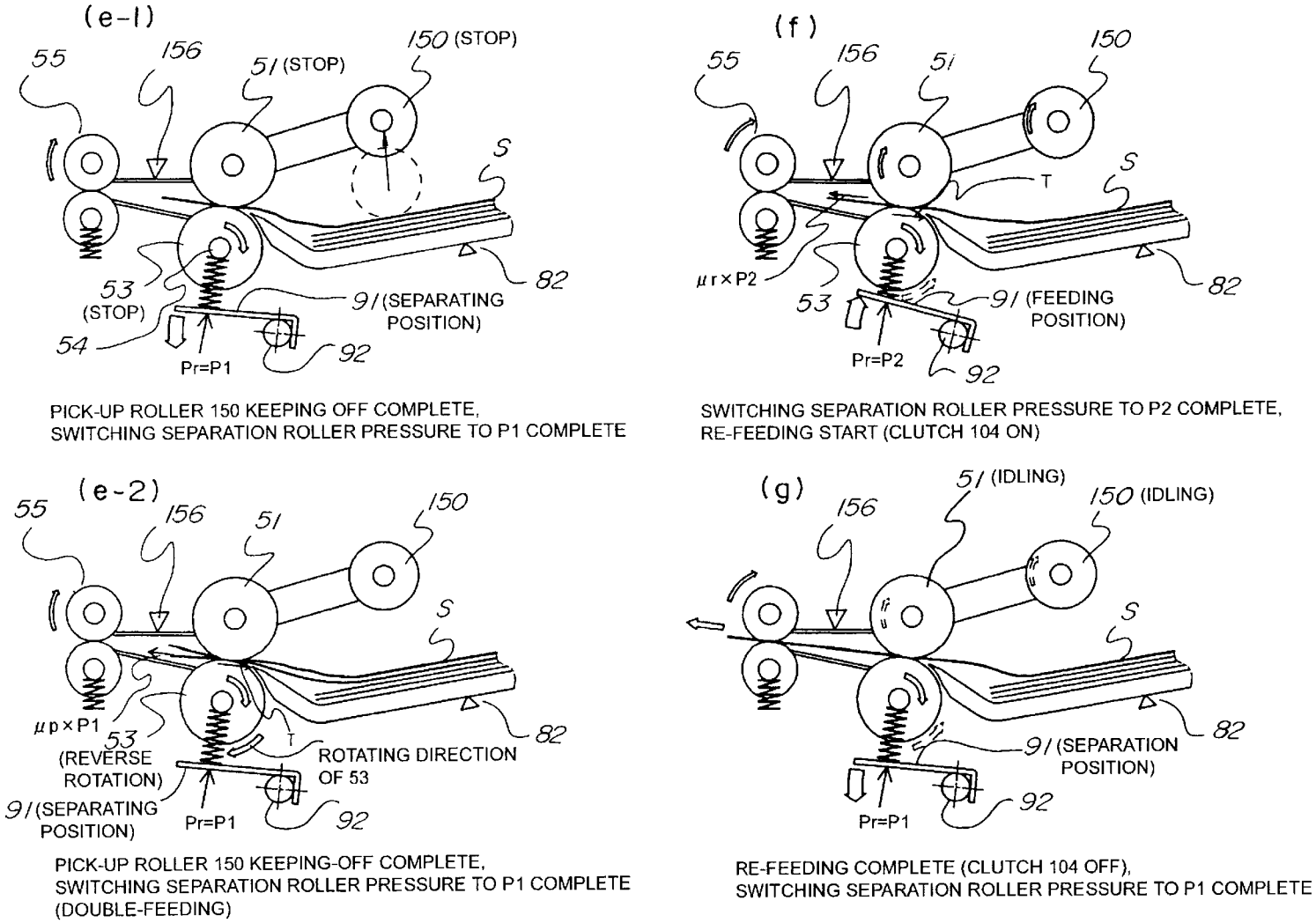
FIG. 20 is a view showing a state of operation of the multi-feeding section of the third embodiment.
Figure 21:
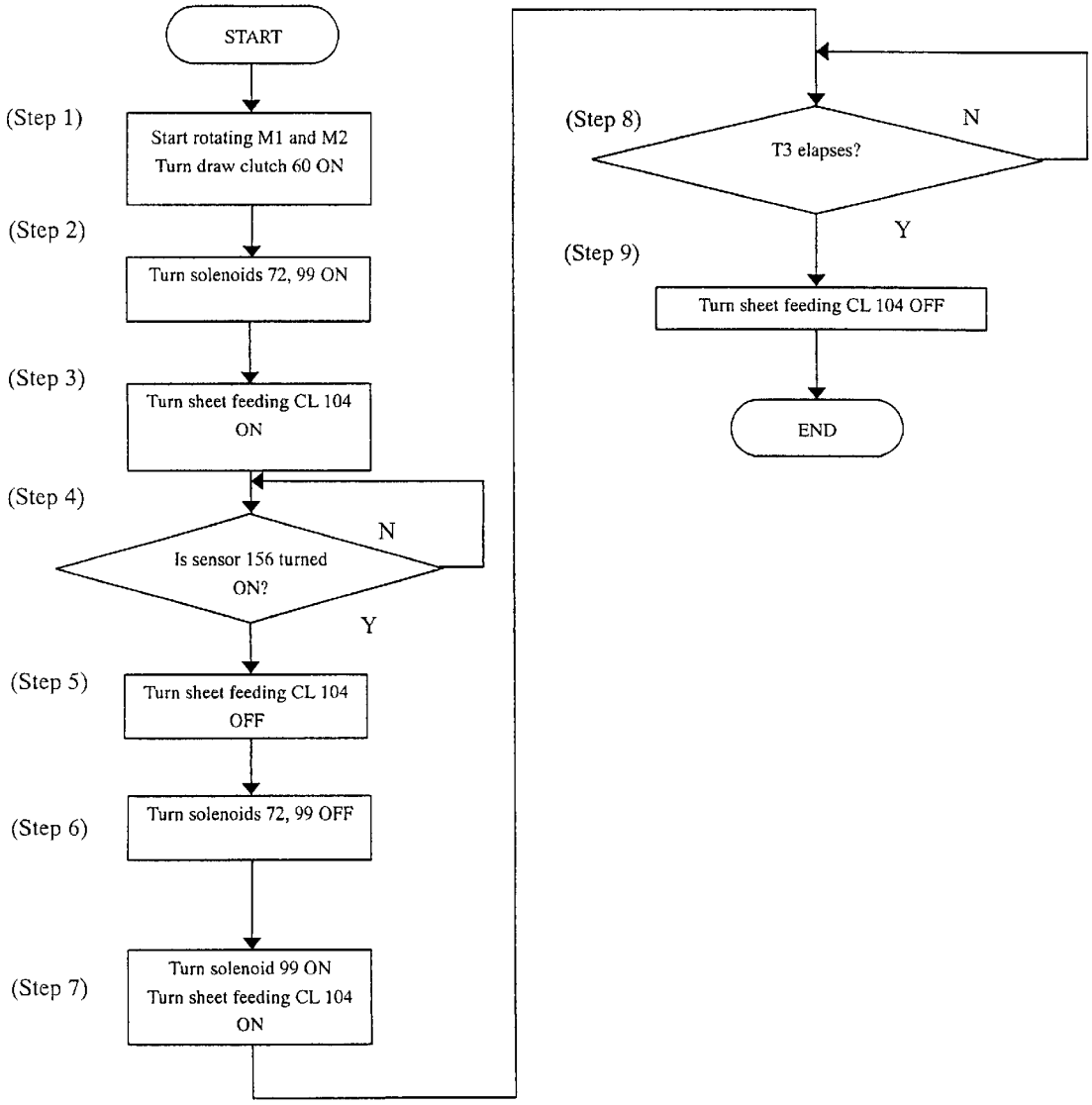
FIG. 21 is an operation flowchart during the sheet feeding of the third embodiment.

Since the pressure switching solenoid 99 is turned OFF, the spring receiver 91 of the separation roller pressing spring 73 is maintained in the solid line position in FIG. 2, with the result that the pressure Pr of the separation roller becomes P1 (FIG. 19-*a* and FIG. 21; Step 1).

Then, the pick-up solenoid 155 and the pressure switching solenoid 99 are respectively turned ON. By turning ON the pick-up solenoid 155, the pick-up roller 150 directly contacts with the uppermost sheet S on the sheet feeding tray 74. In addition, by turning ON the pressure switching solenoid 99, the pressure Pr of the separation roller 53 is changed to be a higher value P2. Incidentally, during this time, the sheet feeding driving clutch 104 is turned OFF, so the sheet feeding roller 51 and the pick-up roller 150 are stopped (FIG. 19-*b* and FIG. 21; Step 2).

The sheet feeding driving clutch 104 is turned ON at a predetermined timing to start the sheet feeding operation (FIG. 21; Step 3). The pick-up roller 150 pressingly contacted with the sheet S feeds out the sheet S to the direction of the sheet feeding roller 51. The sheet S thus fed out is pinched at the nip portion between the sheet feeding roller 51 and the separation roller 53 to be conveyed, by receiving the conveying force of the sheet feeding roller 51, to the pair of the draw rollers 55. Thereafter, when the leading end of the sheet S is detected by the sheet detecting sensor 156, the sheet feeding driving clutch 104 is turned OFF, with the result that the sheet feeding operation is temporarily stopped (the sheet feeding operation till now is referred to as "pre-feeding operation" hereinafter)(FIGS. 19-*c, d* and FIG. 21; Step 4, 5).

In a state where the sheet feeding operation is temporarily stopped, the pick-up solenoid 155 and the pressure switching solenoid 99 are turned OFF. Consequently, the pick-up roller 150 is estranged from the sheet S to be moved to the escaping position. In addition, the rotating shaft 92 is rotated to switch the pressure Pr of the separation roller 53 to a lower value P1 (FIG. 20-*e* and FIG. 21; Step 6).

The sheet S stopping being fed is pinched at the nip portion between the stopping sheet feeding roller 51 and the separation roller 53 where the driving force is transmitted to the separation roller driving shaft 54, and the pick-up roller 150 becomes further estranged from the sheet S. In this situation, as shown in FIG. 20(*e*-2), if double-fed sheets drivingly taken with the sheet S exist in the nip, the separation roller 53 rotates in a sheet restoring direction by the action of the torque limiter 62, thus to able to restore the sheets certainly.

In addition, the restoring force of the separation roller can be effectively utilized with respect to the double-fed sheets because the pressure Pr of the separation roller 53 is changed to be a lower value P1. Consequently, the advantage of double-feed prevention can be further improved.

After the sheet feeding operation is stopped in a predetermined period of time during which the double-fed sheets can be surely restored on the sheet feeding tray 74, the pressure switching solenoid 99 and the sheet feeding driving clutch 104 are again turned ON. Due to this operation, the pressure is again switched to the higher value P2 and the sheet feeding roller 51 is rotated in the direction to further feed the sheet, with the result that the sheet feeding operation is resumed (FIG. 20-*f* and FIG. 21; Step 7)(this operation is referred to as re-feeding operation hereinafter).

After a predetermined time T3 is elapsed, the sheet feeding driving clutch 104 and the pressure switching solenoid 99 are again turned OFF. Incidentally, the predetermined time T3 is so set as a period of time from a point when the re-feeding operation starts until a point when the leading end of the sheet S can be surely pinched by the pair of draw rollers 55.

Consequently, the driving force from the motor M2 is not transmitted to the sheet feeding roller 51, thus to be in an idling state. In addition, the pressure Pr is changed to be the lower value again (FIG. 20-*g* and FIG. 21; Step 8, 9).

As a result, after the sheet S is pinched by the pair of draw rollers 55, the double-feed is hard to occur since the pick-up roller 150 is estranged from the sheet, but even if the sheets on the sheet feeding tray 74 are driven to be fed, the sheets can be surely separated, since the separation roller driving shaft 54 rotates in a direction opposite to the sheet feeding direction during the rotating operation of the draw rollers 55, and since the pressure Pr is set to be the lower value P1.

The sheet conveying operation after the pair of draw rollers 55 are pinched is the same as that in the abovementioned embodiments, and explanation thereof will be omitted here.

As specifically mentioned above, by setting the pressure Pr of the separation roller 53 with respect to the sheet feeding roller 51 to be higher value P2 in the pre-feeding operation, slip between the sheet feeding roller 51 and the sheet S during the pre-feeding is preventable, thereby carrying out stable pre-feeding operation. Further, the pre-fed sheet S is temporarily stopped, and the pressingly contacting operation of the pick-up roller 150 with respect to the sheets on the sheet feeding tray 74 is released, and the pressure Pr of the separation roller 53 is set to be lower value P1, with the result that the restoring force can be accurately effected, and consequently, the sheets, if double-fed in the pre-feeding operation, can be surely restored, thereby effecting high reliable sheet feeding.

Incidentally, the present embodiment utilizes, as a sheet feeding system, a retard separation system having a pick-up roller, but this is one example, so, in the sheet feeding apparatus (having no pick-up rollers, where an intermediate plate of a sheet feeding tray makes sheets pressed or released from the pressure application with respect to the sheet feeding roller) explained in the first and second embodiments, pressure switching can be also carried out with solenoids.

Providing a pick-up roller allows the roller diameter of the sheet feeding roller to be smaller, thereby achieving further miniaturization of the sheet feeding apparatus. In addition, drive transmission of the pick-up roller can be easily carried out by providing mechanical transmission members such as gears or pulleys without any special configuration.

A difference in appropriate sheet feed area between the prior arts and the present invention will be explained.

Figure 22:
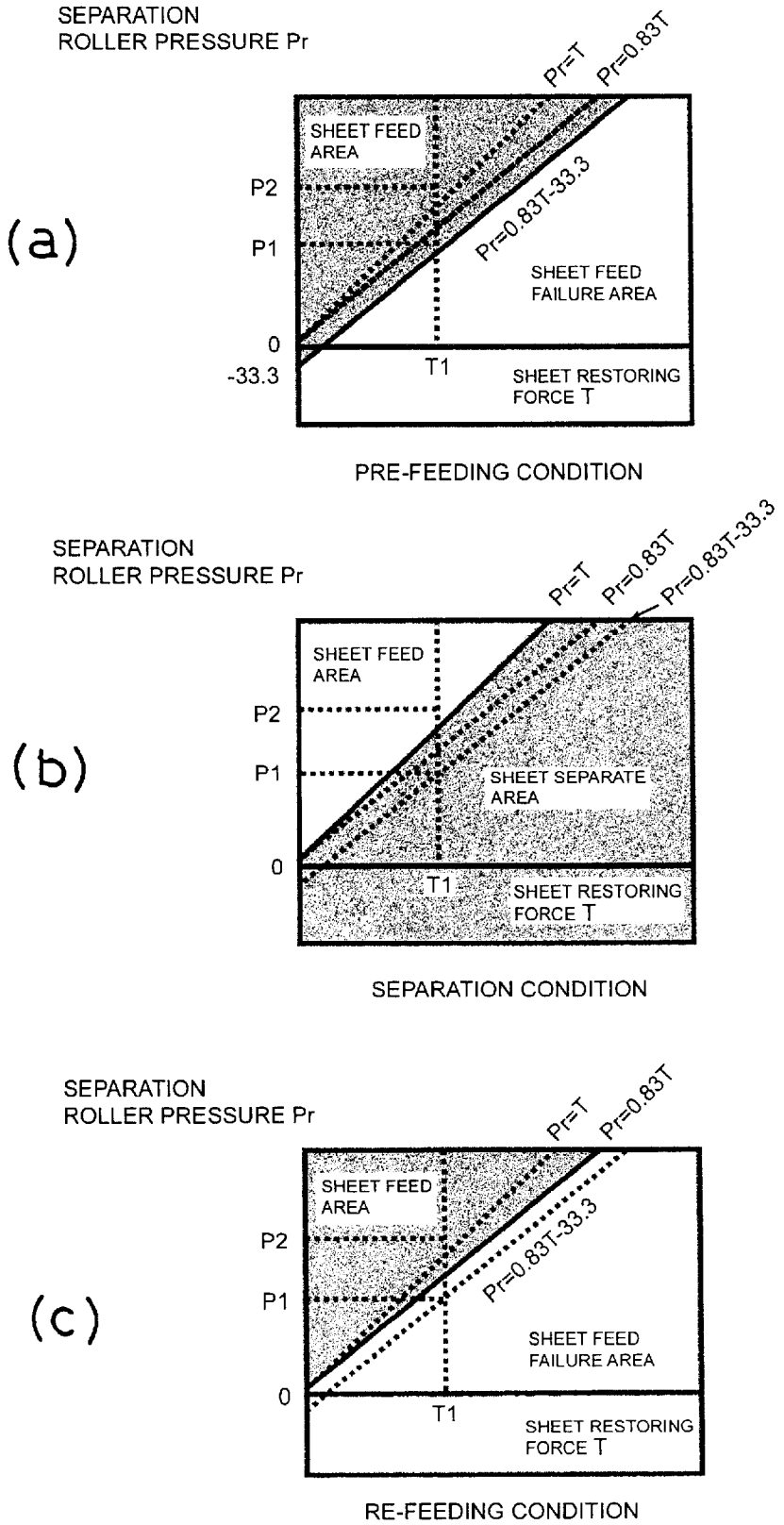
FIG. 22 is characteristic views showing relation between sheet restoring force and separation roller pressure of the multi-feeding section.

First, the appropriate sheet feed area of the sheet feeding apparatus utilizing the present invention will be specifically explained with the reference to FIG. 22. Here, explanation will be made by using the sheet feeding apparatus of the first embodiment, but formulas, sheet feed area graphs and the like are the same in the other embodiments.

Providing that pressure of the separation roller 53 is Pr, pressure of the intermediate plate 70 is Pn, restoring force by the torque limiter 62 is T, frictional coefficient between sheets is $\mu p$, and frictional coefficient between the sheet and the surface of the roller is $\mu r$, feeding and separation condition with respect to the respective operations in the aforementioned first embodiment is expressed as follows.

(1) Condition of conveying the sheet to the sheet feeding/separation roller pair 51, 53 by the pressure Pn of the intermediate plate 70 (feeding condition in FIG. 6(*c*))

In FIG. 6(*c*), conveying force Fa provided only by the pressure Pn of the intermediate plate 70 to the sheet, ignoring the sheet weight, is expressed as follows.

$$Fa=\mu r\times Pn-\mu p\times Pn$$

In order to convey the sheet, the aforementioned Fa is required to be a positive value, and therefore, Fa>0 is a condition for conveying the sheet by the pressure Pn of the intermediate plate 70. Consequently, expressions are as follows.

$$\mu r\times Pn-\mu p\times Pn>0$$

$$\therefore r-\mu p>0 \qquad \text{(Formula 5)}$$

(2) Condition of conveying the sheet by the pressure Pn of the intermediate plate 70 as well as the sheet feeding/separation roller pair 51, 53 (feeding condition in FIG. 6(*d*))

In FIG. 6(*d*), conveying force Fb provided by the pressure Pn of the intermediate plate 70 and the pressure Pr of the separation roller to the sheet, ignoring the sheet weight, is expressed as follows.

$$Fb=\mu r\times Pn+\mu r\times Pr-T-\mu p\times Pn$$

In order to convey the sheet, the aforementioned Fb is required to be a positive value, and therefore, Fb>0 is a condition for conveying the sheet by the pressure Pn of the intermediate plate 70 and the pressure Pr of the separation roller 53. Consequently, expressions are as follows.

$$\mu r\times Pn+\mu r\times Pr-T-\mu p\times Pn>0$$

$$(\mu r-\mu p)\times Pn+\mu r\times Pr-T>0$$

$$\therefore Pr>T/\mu r-Pn\times(\mu r-\mu p)/\mu r \qquad \text{(Formula 6)}$$

In these functions, values 200 gf, 1.2, and 1.0 are assigned to Pn of the pressure of the intermediate plate 70, $\mu r$ of the frictional coefficient between the sheet and the roller, and $\mu p$ of the frictional coefficient between the sheets respectively. Incidentally, it is assumed that the frictional coefficients are measured after the apparatus is endured as well as when special sheets are fed. The aforementioned Formula 6 is performed by assigning those values, giving the following.

$$Pr>0.83\times T-33.3$$

Therefore, even in the case that the frictional coefficient $\mu r$ of the roller surface is lowered due to endurance, the shaded area in FIG. 22(*a*) becomes under the condition of Pr and T which are capable of feeding the sheet.

Incidentally, since the pressure Pr of the separation roller at this time is switched to a higher value P2, further stable conveyance can be achieved when the restoring force T is T1. Furthermore, during this pre-feeding operation, the sheets, if double-fed, can be certainly separated in the separating operation to be explained later, so it is enough to satisfy the above conditions in the pre-feeding operation. (3) Condition of separating double-fed sheets by separation roller 53 after the intermediate plate 70 is estranged (separation condition in FIG. 7(*e*-2))

Figure 7:
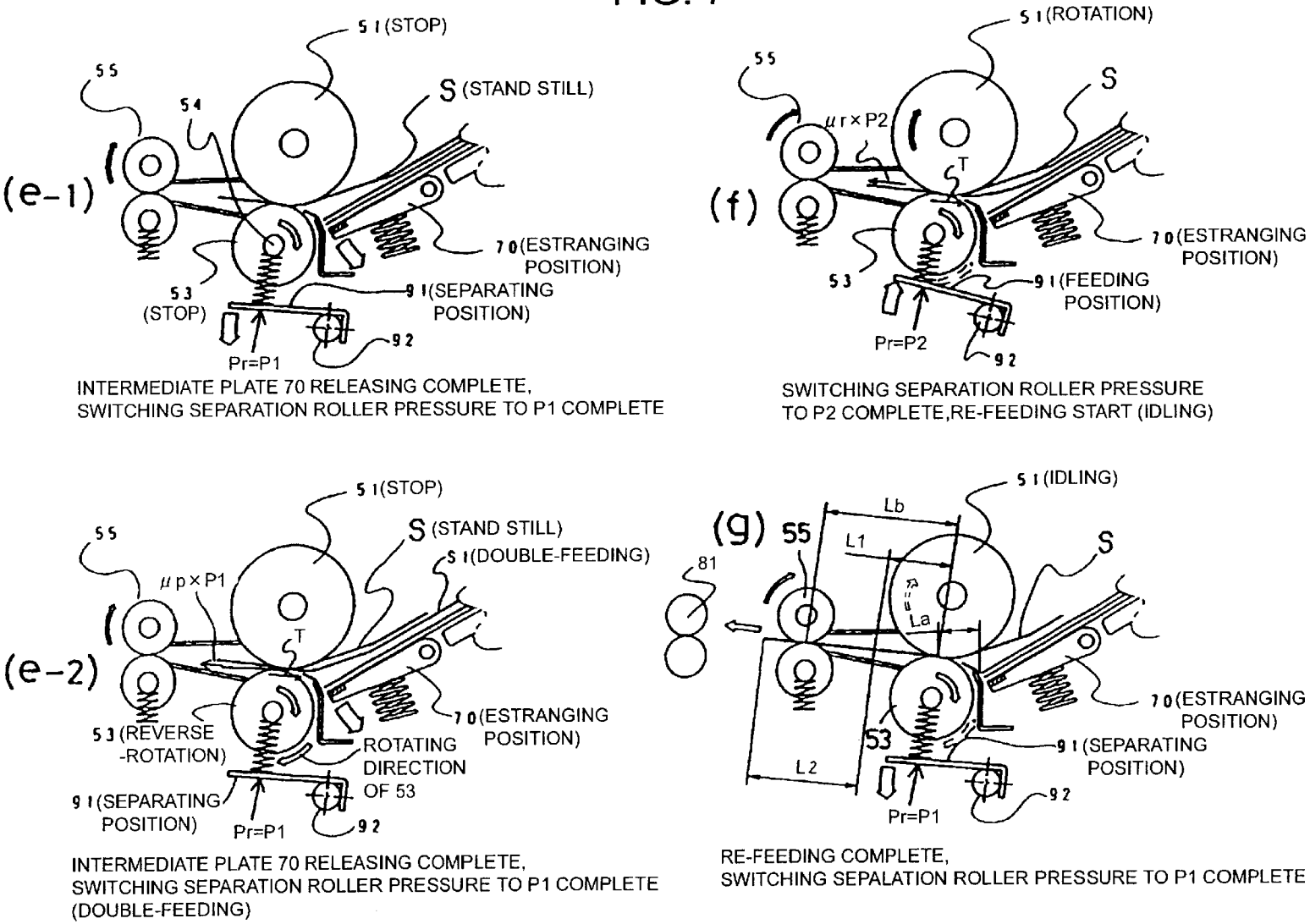
FIG. 7 is a view showing a state of operation of the multi-feeding section of the first embodiment.

In FIG. 7(*e*-2), conveying force Fc for restoring the double-fed sheet S1 in a direction opposite to the conveying direction by the separation roller 53 after the intermediate plate 70 is estranged, ignoring the sheet weight, is expressed as follows.

$$Fc=T-\mu p\times Pr$$

In order to restore the double-fed sheet S1, the aforementioned Fc for restoring the double-fed sheet S1 is required to be a positive value, and therefore, Fc>0 is a condition for separating the double fed sheet S1. Consequently, expressions are as follows.

$$T-\mu p\times Pr>0$$

$$\therefore Pr<T/\mu p \qquad \text{(Formula 7)}$$

In these functions, as the same way in (2), values 200 gf, 1.2, and 1.0 are assigned to Pn of the pressure of the intermediate plate 70, $\mu r$ of the frictional coefficient between the sheet and the roller, and $\mu p$ of the frictional coefficient between the sheets respectively, and the aforementioned Formula 7 gives the following.

$$Pr<1.0\times T$$

Even in the case that a special sheet having an extremely high frictional coefficient between the sheets of $\mu p$, the shaded area in FIG. 22(*b*) becomes under condition of Pr and T which are capable of separating the sheet.

Incidentally, since the separation roller pressure Pr takes the lower value P1 at this point, the member of $\mu p\times Pr$, in Formula 7, showing conveying resistance for restoring the sheet becomes a small value, and as a result, Fc, conveying force for restoring the double-fed sheet, becomes a large value, thereby achieving further stable separation operation. Here, in this separating operation, there is no condition for feeding the sheet because the sheet feeding roller 51 is stopped and only the separating operation is carried out, and therefore, it is enough to satisfy Formula 7.

(4) Condition of conveying one piece of sheets only by sheet feeding/separation roller pair 51, 53 (feeding condition in FIG. 7(*f*))

In FIG. 7(*f*), conveying force Fd provided by the pressure Pr of the separation roller 53 after the intermediate plate 70 is estranged, ignoring the sheet weight, is expressed as follows.

$$Fd=\mu r\times Pr-T$$

In order to convey the sheet, the aforementioned Fd is required to be a positive value, so Fd>0 is a condition for conveying the sheet only by the sheet feeding/separation roller pair 51, 53. Consequently, expressions are as follows.

$$\mu r\times Pr-T>0$$

$$\therefore Pr>T/\mu r \qquad \text{(Formula 8)}$$

In these functions, as in the same way as those of the aforementioned conditions, the values 200 gf, 1.2, and 1.0 as are assigned to Pn, $\mu r$, and $\mu p$ respectively, and the aforementioned Formula 8 gives the following.

$$Pr>0.83\times T$$

Therefore, even in the case that the frictional coefficient $\mu r$ of the roller surface is lowered due to endurance, the shaded area in FIG. 22(*c*) becomes under the condition of Pr and T which are capable of feeding the sheet.

Incidentally, the pressure Pr of the separation roller at this time becomes the higher value P2, so the sheet conveying force Fd takes a larger value, thereby achieving greatly stable sheet feeding operation.

As seen from the aforementioned descriptions, the sheet feeding apparatus of the present invention can perform the stable feeding operation and separating operation without greatly influenced by materials of sheets, wears of rollers or the like.

Appropriate sheet feed area according to the prior arts will be explained hereinafter.

Figure 23:
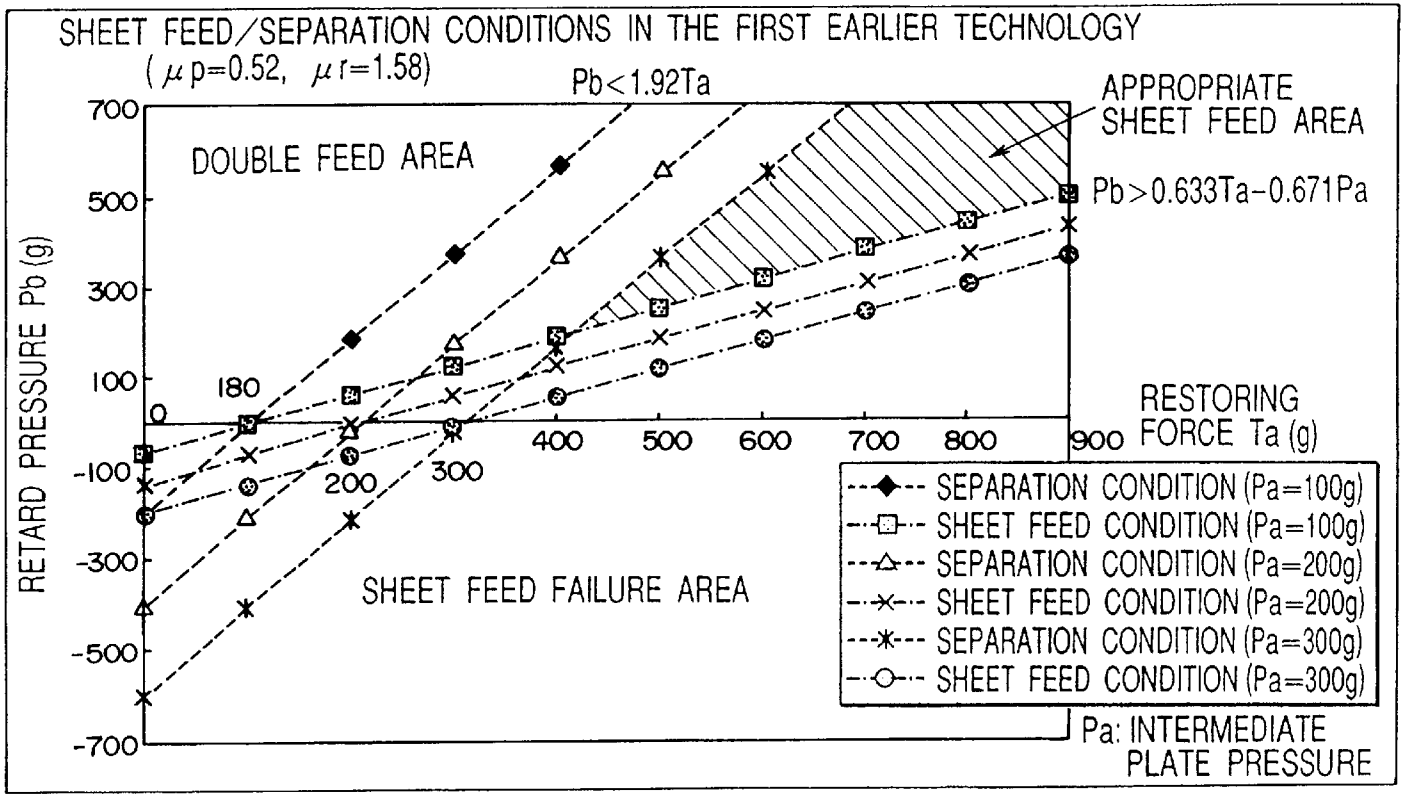
FIG. 23 is a graph showing feeding conditions and separation conditions of each value of Pa=100 g, 200 g, and 300 g, by making relations between sheet restoring force Ta, and intermediate plate pressure Pa, and separation roller pressure Pb shown as a function.

FIG. 23 shows the appropriate sheet feed area of the sheet feeding apparatus utilizing a mechanism of the first prior art (where values are based on calculations). Incidentally, the numeral values and formulas used in FIG. 23 are quoted from those used in the first prior art. Such formulas are as follows.

Formula of sheet feeding condition $$Pb>Ta/\mu r+\{(\mu p/\mu r)-1\}-Pa \qquad \text{(Formula 9)}$$

Formula of separation condition $$Pb<Ta/\mu p-2Pa \qquad \text{(Formula 10)}$$

Here, Pb is a separation roller pressure generated by the retard spring, Ta is a sheet restoring force by the separation roller, Pa is a pressing force of an intermediate plate (intermediate plate pressure) with respect to the sheet feeding roller, $\mu p$ is a frictional coefficient between the respective sheets, and $\mu r$ is a frictional coefficient between the sheet and the sheet feeding roller or between the sheet and separation roller. Incidentally, Ta is a value obtained from the following.

Ta=torque of a torque limiter/radius of a separation roller

FIG. 23 shows the feeding condition and separation condition, which are sought regarding Pa=100 g, 200 g, 300 g respectively, based on the formulas as which a relation between the sheet restoring force Ta, the intermediate plate pressure Pa, and the separation roller pressure Pb are shown, as mentioned above. Incidentally, the calculation is performed assuming that $\mu p$ of the frictional coefficient between the respective sheets and $\mu r$ of the frictional coefficient between the sheet and the sheet feeding roller or between the sheet and the pick-up roller are 0.52 and 1.58 respectively, in accordance with the first prior art.

In the case of the first prior art in which the intermediate plate applies pressure with respect to the sheet feeding roller in the separating operation, the relation between the restoring force Ta of the separation roller and the separation roller pressure Pb is greatly influenced by the intermediate plate pressure Pa, and when the restoring force Ta is less than 400 g (Ta<400 g), there is no appropriate sheet feed area. Since the intermediate plate pressures Pa vary with the number of sheets stacked on the intermediate plate, it is considered that it is very difficult to stabilize the appropriate sheet feed area and widen the range of the appropriate sheet feed area in the first prior art.

Figure 24:
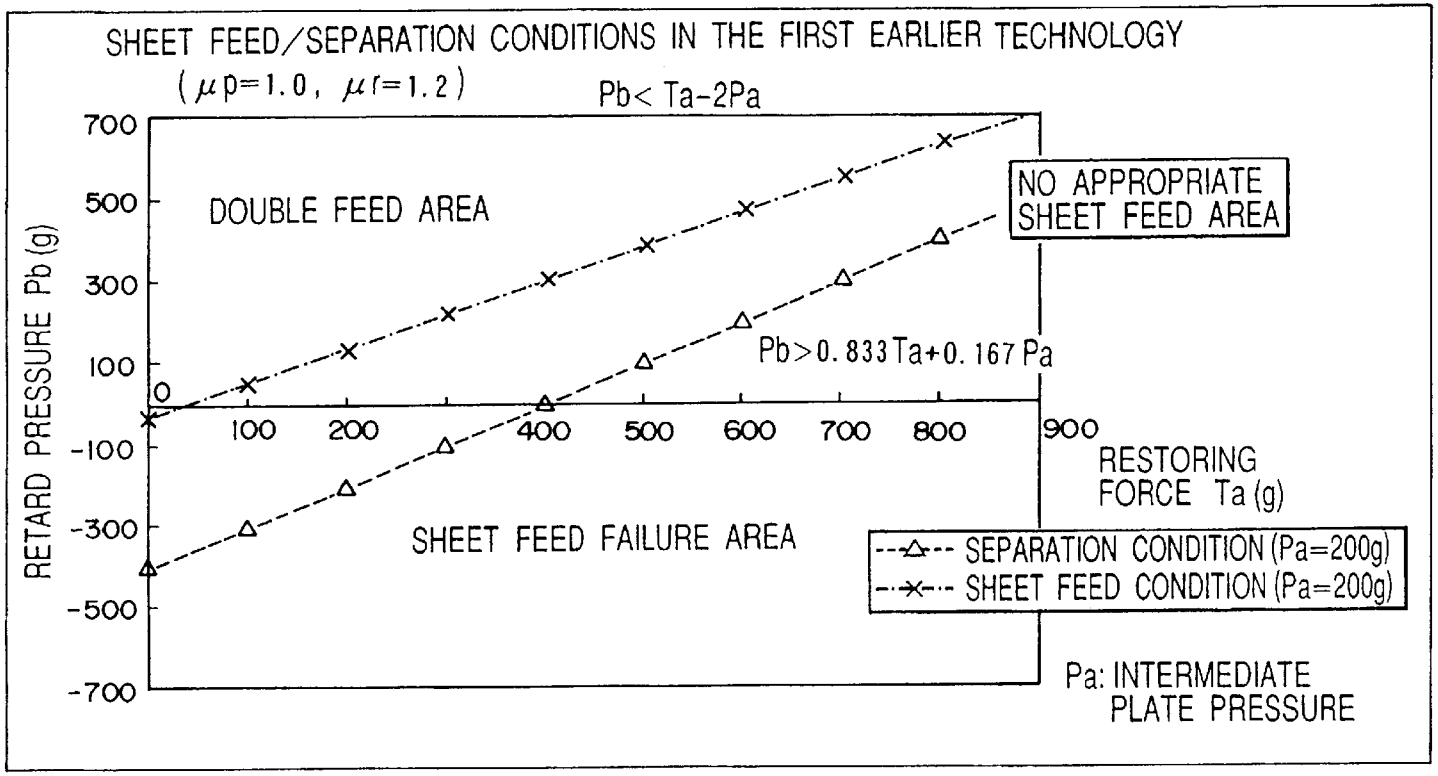
FIG. 24 is a graph given by assigning values at the time of endurance and special sheet feeding operation, respectively to Pn of pressure of an intermediate plate, $\mu p$ of frictional coefficient between sheets, and $\mu r$ of frictional coefficient between a sheet and a roller.
Figure 25:
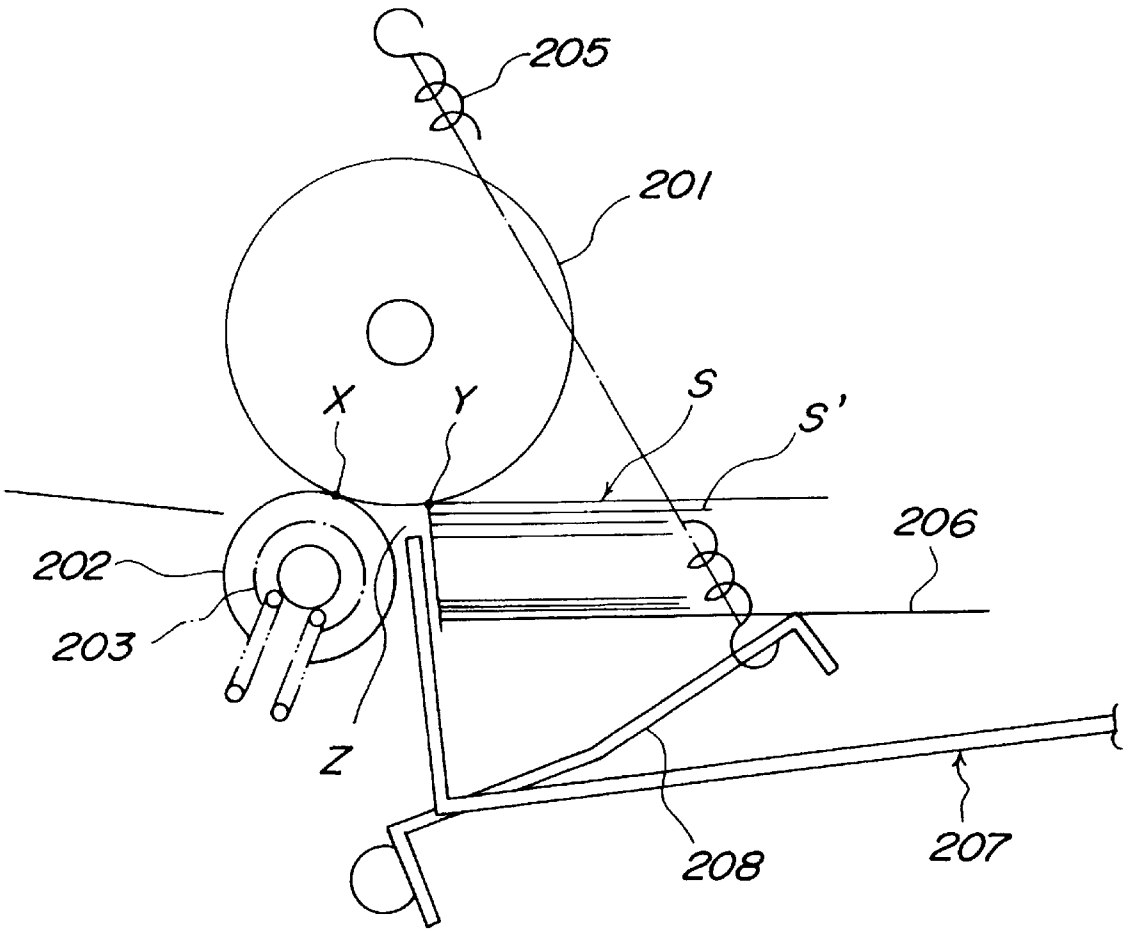
FIG. 25 (PRIOR ART)
FIG. 25 is a schematic side view of a first prior art.
Figure 26:
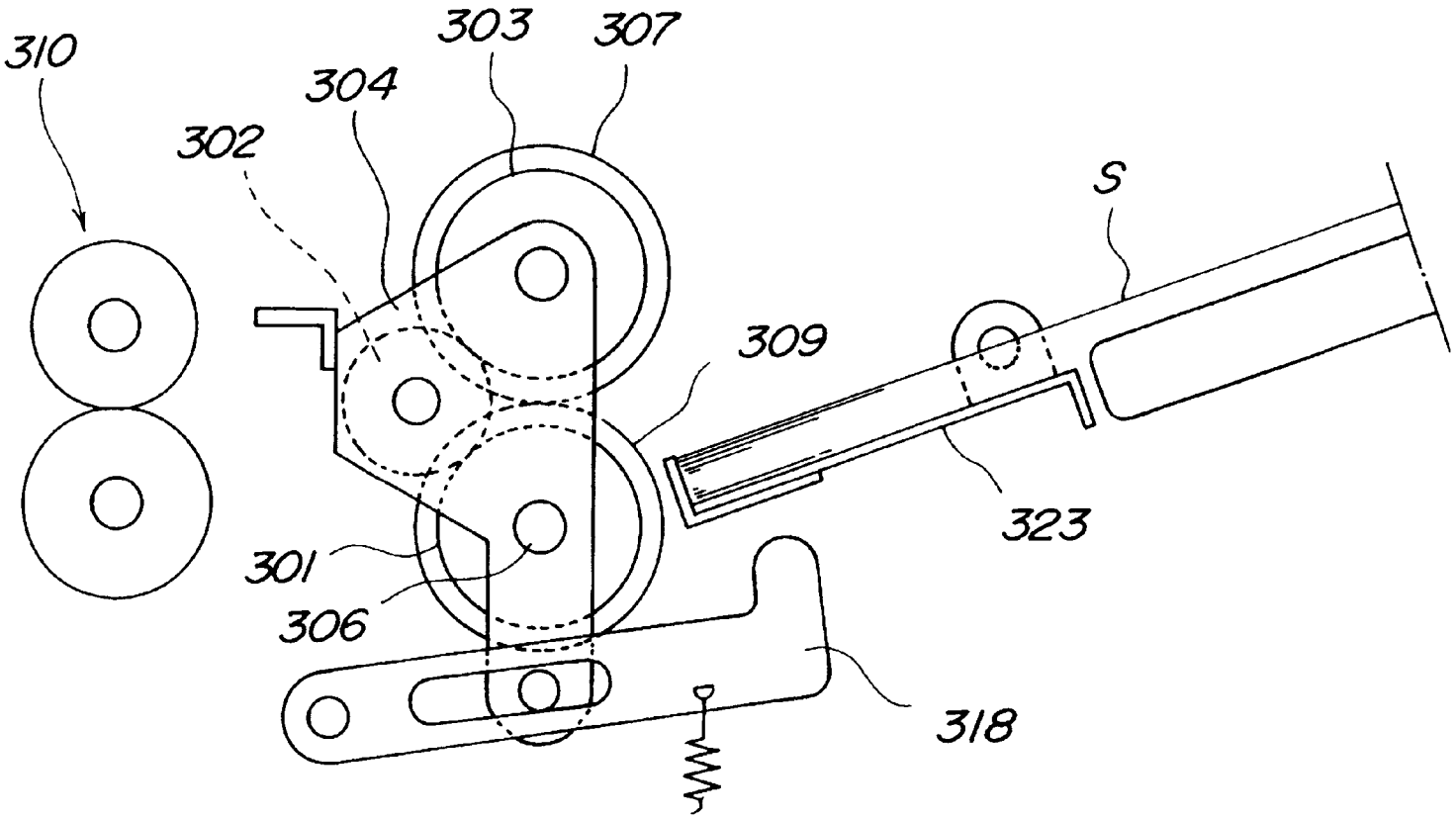
FIG. 26 (PRIOR ART)
FIG. 26 is a schematic side view showing an initial state of a second prior art.
Figure 27:
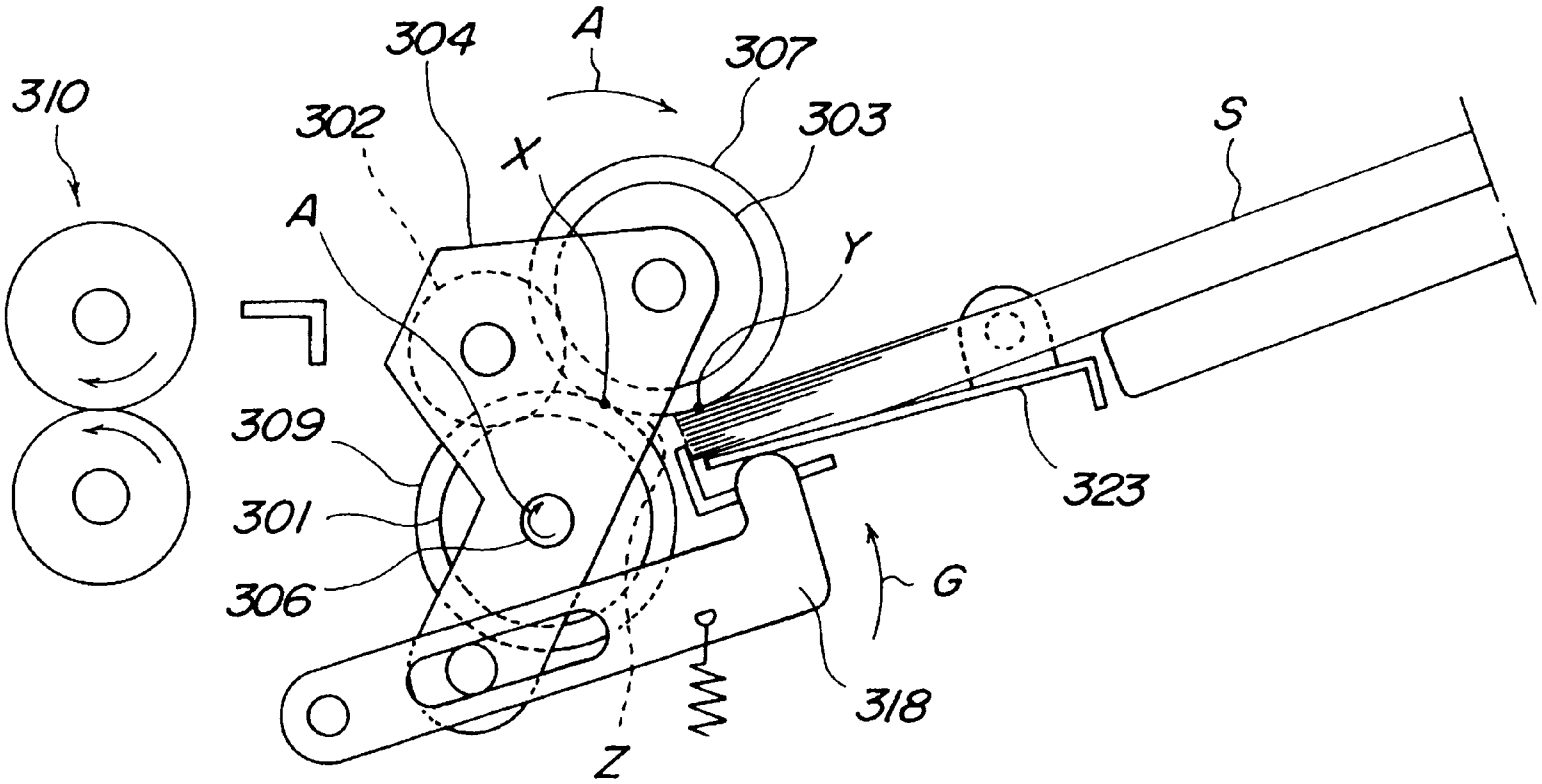
FIG. 27 (PRIOR ART)
FIG. 27 is a schematic side view showing an sheet feeding state of the second prior art.

In FIG. 24, in the same way as that in the aforementioned sheet feeding apparatus according to the present invention, the values at the time of endurance and special sheet feeding operation are respectively assigned to Pn of the pressure of the intermediate plate, $\mu p$ of the frictional coefficient between the sheets, and $\mu r$ of the frictional coefficient between the sheet and the roller.

As shown in FIG. 24, there is no appropriate sheet feed area in a range of the sheet restoring force Ta less than 900 g, or Ta<900 g. In this condition, it is very difficult to carry out the stable sheet feeding and separating operations.

In the present invention, on the other hand, since the intermediate plate is estranged from the sheet feeding roller in the separating operation and the re-feeding operation, the intermediate plate pressure Pn has no influence on the relation between the restoring force T of the separation roller and the separation roller pressure Pr. Therefore, the appropriate sheet feed area can be secured with a greatly wide range. As a result, without greatly influenced by the materials of the sheets or the wears of the rollers, the stable feeding operation and the separating operation can be performed. The difference in the appropriate sheet feed area between the prior art and the present invention clearly depends on whether the intermediate plate pressure acts on the sheet feeding roller or not in the separating operation.

Although not shown, a relation between the restoring force and the separation roller pressure of the second prior art is substantially the same as that in the first prior art. The reason is that, in the second prior art, the sheet feeding pressure of the sheet feeding roller with respect to the sheets stacked on the intermediate plate is released by the entering of the conveyed sheet into the nip between the pair of draw rollers. This means that the sheet feeding roller still applies pressure on the intermediate plate at the stage of the separating operation.

That is to say, there is the separating operation, in the second prior art, similar to that in the first prior art in which the intermediate plate pressure Pa affects the relation between the restoring force Ta of the separation roller and the separation roller pressure Pb in the separating operation. Thus, the relationship diagram between the restoring force and the separation roller pressure in the second prior art is similar to that in the first prior art.

As mentioned above, with reference to figures, regarding the difference in appropriate sheet feed area between the prior art and the present invention, the present invention can widen the appropriate sheet feed area in comparison with the prior art. Thus, the reliable and stable feeding operation and separating operation can be realized.

Although, in each of the embodiments, the sheet feeding means and the separation roller 53 are respectively driven by utilizing the independent motors as mentioned above, no problem occurs when the sheet feeding means and the separation roller are synchronizingly controlled by a single driving motor, and the effects thus obtained are similar to those in the respective embodiments.

Incidentally, in the embodiment according to the present invention, the spring clutch 68 is used for controlling one revolution of the driving gear 80, but the present invention is not limited to this; for example, a stepping motor may be used as the sheet feeding motor M2 for controlling one revolution.

Also, in the each of the embodiments, the sheet feeding motor M1 is used to provide driving force for the sheet feeding means and the intermediate plate 70, and the draw motor M2 is used to provide driving force for the draw rollers 55 and the separation roller 53, but the present invention is not limited to these, and the driving force may distributed from motors for driving the drum 12, the fixing unit 22 and the like.

Further, in the each of the embodiments, the separation roller 53 is provided with the torque limiter 62 to receive a predetermined torque in a direction opposite to the sheet conveying direction, but the present invention is not limited to the torque limiter 62, and other torque limiter may be used as long as it can provide the separation roller 53 with such torque.

In the aforementioned first and second embodiments, the structure in which the gears with the notched portions as a non-engagement portion and two cam portions conduct operations such as the rotation and stopping rotation of the sheet feeding roller, the pressurization and estrangement of the intermediate plate, and the switching pressure of the separation roller, was explained in detail, but the present invention is not limited to this; for example, such a sheet feeding apparatus is applicable as performing the sheet conveyance by utilizing a driving gear with one toothless portion, without stopping the sheet feeding roller temporarily.

Although, in each of the aforementioned embodiments, the examples where the present invention is applied to the multi-feeding section are raised for explanation, but it is, as a matter of course, applicable in a cassette feeding section or a deck sheet feeding section.

Furthermore, in each of the aforementioned embodiments, examples in which the sheet feeding apparatus is applied to the copying machine as the image forming apparatus are explained, but the present invention is not limited to this, and the present invention can be applied to an image reading apparatus, for reading images recorded on the sheet, having an image reading section on a downstream side of the sheet feeding apparatus in the sheet conveying direction.

As specifically described above, the present invention can prevent slips or double-feed as well as performs the stable sheet feeding operation, by changing the sheet pressure of the separation rotator with respect to the feeding means in the sheet feeding operation.

What is claimed is:

1. A sheet feeding apparatus comprising:

sheet supporting means for supporting a sheet;

feeding means pressingly contacted with the sheets supported on the sheet supporting means, the feeding means rotating in a sheet conveying direction for feeding the sheets;

a separation rotator pressingly contacted with the feeding means, the separation rotator rotating in a direction of restoring the sheets so as to separate, sheet by sheet, the sheets fed out from the feeding means; and pressure switching means for switching pressure of the separation rotator with respect to the feeding means during a sheet feeding operation of the feeding means.

2. The sheet feeding apparatus according to claim 1, wherein the pressure switching means switches the pressure of the separation rotator with respect to the feeding means to a higher value when the sheets supported on the sheet supporting means and the feeding means are pressingly contacted each other, and the pressure switching means switches the pressure of the separation rotator with respect to the feeding means to a lower value when the pressing contact between the sheets supported on the sheet supporting means and the feeding means is released, and thereafter the pressure switching means switches the pressure of the separation rotator with respect to the feeding means again to a higher value at a predetermined timing.

3. The sheet feeding apparatus according to claim 2, wherein said pressure switching means further comprises a solenoid, and wherein switching on and off of the solenoid switches the pressure of the separation rotator with respect to the feeding means.

4. The sheet feeding apparatus according to claim 3, wherein the pressure switching means comprises a rotating shaft rotatably supported on the sheet feeding apparatus and a holding member, secured to the rotating shaft, for holding an elastic member provided so as to make the separation rotator continuously pressing the feeding means, and wherein the solenoid is connected to the holding member, and according to turning ON and OFF of the solenoid, the holding member move rotatively on the rotating shaft as a fulcrum to change pressure of the elastic member, with the result that the pressure of the separation rotator with respect to the feeding means is changed.

5. The sheet feeding apparatus according to claim 2, wherein the pressure switching means comprises:

a rotating shaft rotatably supported on the sheet feeding apparatus;

a holding member, secured to the rotating shaft, for holding an elastic member provided so as to make the separation rotator normally pressing the feeding means;

a pressure switching cam portion provided so as to rotate by driving force of drive transmitting means; and a pressure switching cam follower portion secured to the rotating shaft and directly contacted with the pressure switching cam portion, wherein the pressure switching cam portion rotates by receiving the driving force of the drive transmitting means, and the pressure switching cam follower portion moves along a cam shape of the pressure switching cam portion to rotate the rotating shaft and to displace the holding member for holding the elastic member, resulting in that the pressure with which the separation rotator provides the feeding means is switched.

6. The sheet feeding apparatus according to claim 1, comprising:

conveying means, provided on a downstream side of the feeding means in a sheet conveying direction, for conveying the sheets fed out from the feeding means; and pressing and estranging means for carrying out pressingly contacting operation between the feeding means and the sheets supported on the sheet supporting means to feed out the sheets and for releasing the pressingly contacting operation between the feeding means and the sheets before a leading end of a sheet fed out from the sheet supporting means reaches at the conveying means.

7. The sheet feeding apparatus according to claim 6, wherein the pressing and estranging means comprises:

a pressing and estranging cam portion provided so as to rotate in association with the rotation of the feeding means; and a pressing and estranging cam follower portion provided in the sheet supporting means and directly contacted with or estranged from the pressing and estranging cam portion, wherein the pressing and estranging cam portion rotates in association with the rotation of the feeding means to be directly contacted with or estranged from the pressing and estranging cam follower portion so that the sheets supported on the sheet supporting means are pressingly contacted or released from the pressingly contacting operation with the feeding means.

8. The sheet feeding apparatus according to claim 7, wherein the pressing and estranging means comprises a swinging spring for providing urging pressure in a direction to which the sheet supporting means is always pressingly contacted with the feeding means, the pressing and estranging means makes the sheets, supported on the sheet supporting means and pressingly contacted with the feeding means, estranged from the feeding means by resisting the urging pressure of the swinging spring by means of the directly contacting operation between the pressing and estranging cam portion and the pressing and estranging cam follower portion, and the pressing and estranging means makes the sheets supported on the sheet supporting means pressingly contacted with the feeding means by the urging pressure of the swinging spring by means of the estrangement of the pressing and estranging cam portion from the pressing and estranging cam follower portion.

9. The sheet feeding apparatus according to claim 6, wherein, before a leading end of the sheet fed out from the sheet supporting means reaches at the conveying means by the feeding means, the pressing and estranging means displaces the sheet supporting means making the sheets pressingly contacted with the feeding means, thereby releasing the pressingly contacting operation between the feeding means and the sheets.

10. The sheet feeding apparatus according to claim 1, further comprising drive transmitting means for transmitting driving force to the feeding means, the drive transmitting means comprising:

a driving gear for receiving rotation from a motor generating the driving force; and a feeding gear, provided in a position of engaging with the driving gear, rotating along with the feeding means.

11. The sheet feeding apparatus according to claim 10, wherein the driving gear is a partially toothless gear comprising non-engagement portions at which engagement with the feeding gear is released.

12. The sheet feeding apparatus according to claim 10, wherein the driving gear is a stage gear combining a first and a second segment gears, wherein the two feeding gears are provided so as to engage with each of the segment gears, and wherein rotation of the stage gear rotates or stops the feeding means as well as switches rotating speed of the feeding means during the sheet feeding operation.

13. The sheet feeding apparatus according to claim 12, wherein the driving gear rotates the feeding means at a first conveying speed while the sheets supported on the sheet supporting means are pressingly contacted with the feeding means, and the driving gear rotates the sheet at a second conveying speed faster than the first conveying speed after the sheets are released from the pressingly contacting operation with the feeding means by the pressing and estranging means.

14. The sheet feeding apparatus according to claim 13, wherein the second conveying speed is approximately the same as a sheet conveying speed of the conveying means.

15. The sheet feeding apparatus according to claim 1, wherein the feeding means comprises:

a pick-up roller for pressingly contacting with the sheets supported on the sheet supporting means and feeding out the sheet in a direction of the separation rotator; and a feeding rotator located on a downstream side of the pick-up roller in the sheet conveying direction and provided so as to be opposed to the separation rotator.

16. The sheet feeding apparatus according to claim 1, wherein said pressure switching means has a stopping means for stopping said feeding means temporarily during sheet feeding operation of the feeding means, and said pressure switching means switches the pressure of the separation rotator with respect to the feeding means when said feeding means is stopped by said stopping means.

17. An image forming apparatus comprising:

sheet supporting means for supporting a sheet;

feeding means pressingly contacted with the sheets supported on the sheet supporting means, the feeding means rotating in a sheet conveying direction for feeding the sheets;

image forming means for forming images on sheets fed out from the feeding means;

a separation rotator pressingly contacted with the feeding means, the separation rotator rotating in a direction of restoring the sheets so as to separate, sheet by sheet, the sheets fed out from the feeding means; and pressure switching means for switching pressure of the separation rotator with respect to the feeding means during a sheet feeding operation of the feeding means.

18. An image reading apparatus comprising:

sheet supporting means for supporting a sheet;

feeding means pressingly contacted with the sheets supported on the sheet supporting means, the feeding means rotating in a sheet conveying direction for feeding the sheets;

image reading means for reading images on sheets fed out form the feeding means;

a separation rotator pressingly contacted with the feeding means, the separation rotator rotating in a direction of restoring the sheets so as to separate, sheet by sheet, the sheets fed out form the feeding means; and pressure switching means for switching pressure of the separation rotator with respect to the feeding means during a sheet feeding operation of the feeding means.

* * * * *

UNITED STATES PATENT AND TRADEMARK OFFICE

CERTIFICATE OF CORRECTION

PATENT NO. : 6,378,858 B1
DATED : April 30, 2002
INVENTOR(S) : Takeshi Suga

Figure 5:
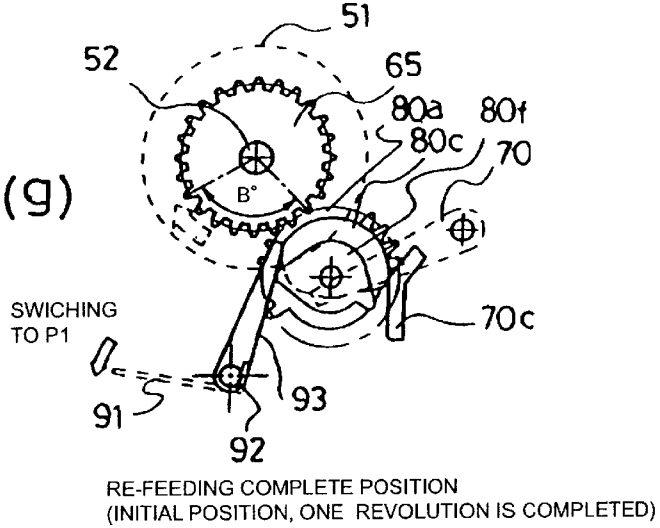
FIG. 5 is a view showing a state of operation of the driving gear of the first embodiment.
Figure 5:
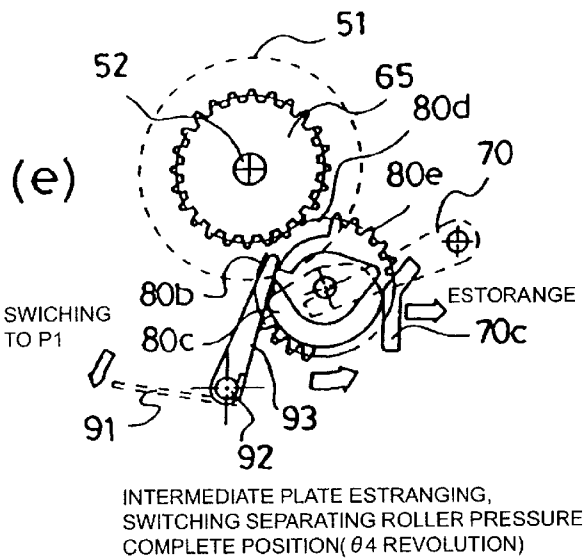
Figure 5:
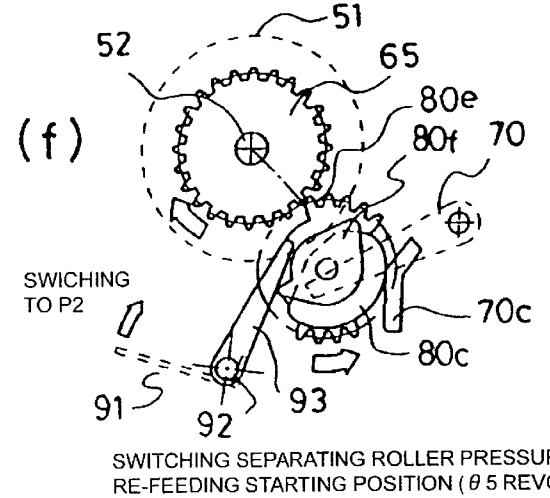

It is certified that error appears in the above-identified patent and that said Letters Patent is hereby corrected as shown below:

Drawings,
Sheet No. 5: Figure 5, “SWICHING” (all occurrences) should read -- SWITCHING -- and “ESTORANGE” should read -- ESTRANGING --.
Sheet No. 11, Figure 11, “PERESSURE” should read -- PRESSURE --.
Sheet No. 12, Figure 12, “PRESUURE” (both occurrences) should read -- PRESSURE -- and “OME” should read -- ONE --.
Sheet No. 14, Figure 14, “(DOWBLE” (both occurrences) should read -- (DOUBLE -- and “DERECTION” should read -- DIRECTION --.

Column 2,
Line 61, “easily” should read -- easily be --.

Column 3,
Line 43, “this” should read -- these --.
Line 59, “sheet” should read -- sheets --.

Column 7,
Line 8, “moment” should read -- movement --.

Column 8,
Line 10, “moment” should read -- movement --.

Column 16,
Line 14, “be also” should read -- also be --.

Column 20,
Line 21, “are” should read -- is --.

Column 21,
Line 28, “shorten.” should read -- shortened --.

Column 22,
Line 29, “apparatuses” should read -- apparatus --.

Column 24,
Line 42, “to able” should read -- to be able --.

Column 25,
Line 2, “value” should read -- value P1 --.
Line 35, “be also” should read -- also be --.

UNITED STATES PATENT AND TRADEMARK OFFICE

CERTIFICATE OF CORRECTION

PATENT NO. : 6,378,858 B1
DATED : April 30, 2002
INVENTOR(S) : Takeshi Suga

It is certified that error appears in the above-identified patent and that said Letters Patent is hereby corrected as shown below:

Column 26,
Line 6, "$\therefore$r-$\mu$p>0" should read -- $\therefore\mu$4-$\mu$p>0 --.

Column 27,
Line 58, "greatly" should read -- greatly being --.

Column 29,
Line 35, "the" (1st occurrence) should be deleted.
Line 40, "may" should read -- may be --.
Line 43, "the" (1st occurrence) should be deleted.

Column 34,
Line 2, "form" should read -- from --.
Line 6, "form" should read -- from --.

Signed and Sealed this

Twenty-eighth Day of January, 2003

JAMES E. ROGAN
*Director of the United States Patent and Trademark Office*